US010108140B2

(12) United States Patent
Suzuki

(10) Patent No.: US 10,108,140 B2
(45) Date of Patent: Oct. 23, 2018

(54) DEVELOPER CONTAINING UNIT, DEVELOPMENT PROCESSING UNIT, DEVELOPMENT UNIT, AND IMAGE FORMING APPARATUS

(71) Applicant: Oki Data Corporation, Tokyo (JP)

(72) Inventor: Masayuki Suzuki, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 12 days.

(21) Appl. No.: 15/460,284

(22) Filed: Mar. 16, 2017

(65) Prior Publication Data

US 2017/0285561 A1 Oct. 5, 2017

(30) Foreign Application Priority Data

Mar. 31, 2016 (JP) ..... 2016-070201

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 21/1647* (2013.01); *G03G 21/1676* (2013.01); *G03G 21/1821* (2013.01); *G03G 21/1896* (2013.01)

(58) Field of Classification Search

CPC ..... G03G 21/1647; G03G 21/1676

See application file for complete search history.

(56) References Cited

U.S. PATENT DOCUMENTS

| | | | | |
|---|---|---|---|---|
| 4,561,567 | A | 12/1985 | Wittstein et al. | |
| 5,430,780 | A | 7/1995 | Takeda et al. | |
| 6,229,967 | B1 | 5/2001 | Miya et al. | |
| 2008/0205911 | A1* | 8/2008 | Ishikawa | G03G 15/0896 399/12 |
| 2013/0051814 | A1 | 2/2013 | Itabashi et al. | |

FOREIGN PATENT DOCUMENTS

| | | | |
|---|---|---|---|
| EP | 2574992 | A2 | 4/2013 |
| JP | H01-205175 | A | 8/1989 |
| JP | 2006-099132 | A | 4/2006 |

* cited by examiner

*Primary Examiner* — David M Gray
*Assistant Examiner* — Michael Harrison
(74) *Attorney, Agent, or Firm* — Rabin & Berdo, P.C.

(57) ABSTRACT

A development unit includes an attachable unit and an attached unit. The attachable unit includes an engaging section. The attached unit includes an engaged section that allows the engaging section to be brought into engagement with the engaged section attachably and detachably, and whose state changes in response to the engagement of the engaging section. The state of the engaged section upon the engagement of the engaging section is maintained even after the engaging section is detached from the engaged section.

12 Claims, 11 Drawing Sheets

DEVELOPER CONTAINING UNIT, DEVELOPMENT PROCESSING UNIT, DEVELOPMENT UNIT, AND IMAGE FORMING APPARATUS

CROSS REFERENCE TO RELATED APPLICATIONS

The present application claims priority from Japanese Patent Application No. 2016-070201 filed on Mar. 31, 2016, the entire contents of which are hereby incorporated by reference.

BACKGROUND

The technology relates to: a developer containing unit that contains a developer; a development processing unit that attaches, onto an electrostatic latent image, the developer fed from the developer containing unit; a development unit including the developer containing unit and the development processing unit; and an image forming apparatus that includes the development unit.

An image forming apparatus using an electrophotographic method is in widespread use. One reason for this is that the image forming apparatus using the electrophotographic method is able to achieve a high-quality image in a shorter time, compared to an image forming apparatus using other method such as an inkjet method.

An image forming apparatus forms an image on a surface of a medium such as paper. A process of forming an image involves formation of an electrostatic latent image on a surface of a photosensitive drum, which is followed by attachment of a developer onto the formed electrostatic latent image. The developer attached onto the electrostatic latent image is transferred onto the medium. Thereafter, heat and pressure are applied onto the developer transferred onto the medium. The developer is thereby fixed onto the medium.

The image forming apparatus includes a development unit that attaches the developer onto the electrostatic latent image. The development unit may include a developer containing unit and a development processing unit. The developer containing unit may contain the developer. The development processing unit may attach, onto the electrostatic latent image, the developer fed from the developer containing unit. The developer containing unit may be attachable to and detachable from the development processing unit.

An image forming apparatus that forms a full-color image uses two or more kinds of developers that are colored in colors different from each other. The image forming apparatus is accordingly provided with two or more kinds of developer containing units.

When providing two or more kinds of developer containing units, each of the developer containing units may be provided with, for example, a display directed to distinguishing the developer containing units in order to prevent the two or more developer containing units from being attached mistakenly. For example, reference is made to Japanese Unexamined Patent Application Publication No. 2006-099132.

SUMMARY

Specific consideration has been made in order to prevent attachment from being performed mistakenly. However, measures against attachment performed mistakenly have not been sufficient yet, and there is still room for improvement in preventing attachment from being performed mistakenly.

It is desirable to provide a developer containing unit, a development processing unit, a development unit, and an image forming apparatus that are each able to prevent attachment from being performed mistakenly.

According to one embodiment of the technology, there is provided a development unit that includes an attachable unit and an attached unit. The attachable unit includes an engaging section. The attached unit includes an engaged section that allows the engaging section to be brought into engagement with the engaged section attachably and detachably, and whose state changes in response to the engagement of the engaging section. The state of the engaged section upon the engagement of the engaging section is maintained even after the engaging section is detached from the engaged section.

According to one embodiment of the technology, there is provided a development processing unit that includes an engaged section that allows an engaging section of an attachable unit to be brought into engagement with the engaged section attachably and detachably, and whose state changes in response to the engagement of the engaging section. The state of the engaged section upon the engagement of the engaging section is maintained even after the engaging section is detached from the engaged section.

According to one embodiment of the technology, there is provided a developer containing unit that includes an engaging section that is to be brought into engagement with an engaged section of an attached unit attachably and detachably. The engaging section includes a protrusion that is provided in one of a first protrusion region and a second protrusion region.

According to one embodiment of the technology, there is provided an image forming apparatus that includes the foregoing development unit.

DETAILED DESCRIPTION

Some example embodiments of the technology are described below in detail with reference to the drawings. The description is given in the following order.

1. Development Unit: First Example Embodiment
1-1. Overall Configuration
1-2. Detailed Configuration of Development Processor (Development Processing Unit)
1-3. Detailed Configuration of Developer Container (Developer Containing Unit)
1-4. Attachment Mechanism
1-5. Operation
1-6. Workings and Effects
2. Development Unit: Second Example Embodiment
2-1. Configuration
2-2. Operation
2-3. Workings and Effects
3. Image Forming Apparatus
3-1. Overall Configuration
3-2. Operation
3-3. Workings and Effects
4. Modifications <1. Development Unit: First Example Embodiment>

A development unit according to a first example embodiment of the technology is described below.

The development unit described below may be used in an image forming apparatus that forms an image by means of attachment of a developer onto an electrostatic latent image, for example.

It is to be noted that a developer containing unit according to the first example embodiment of the technology and a development processing unit according to the first example embodiment of the technology may be applied to the development unit described below, for example. The developer containing unit and the development processing unit according to the first example embodiment are therefore described together with the development unit according to the first example embodiment below.

<1-1. Overall Configuration>

An overall configuration of the development unit according to the present example embodiment is described below.

Figure 1:
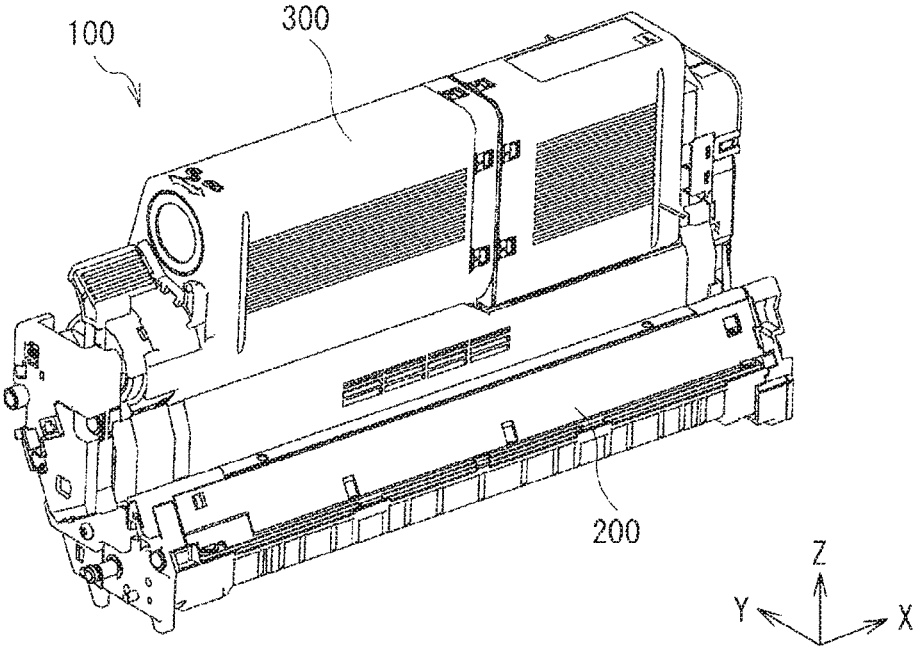
FIG. 1 is a perspective view of a configuration example of a development unit according to first example embodiment of the technology.
Figure 2:
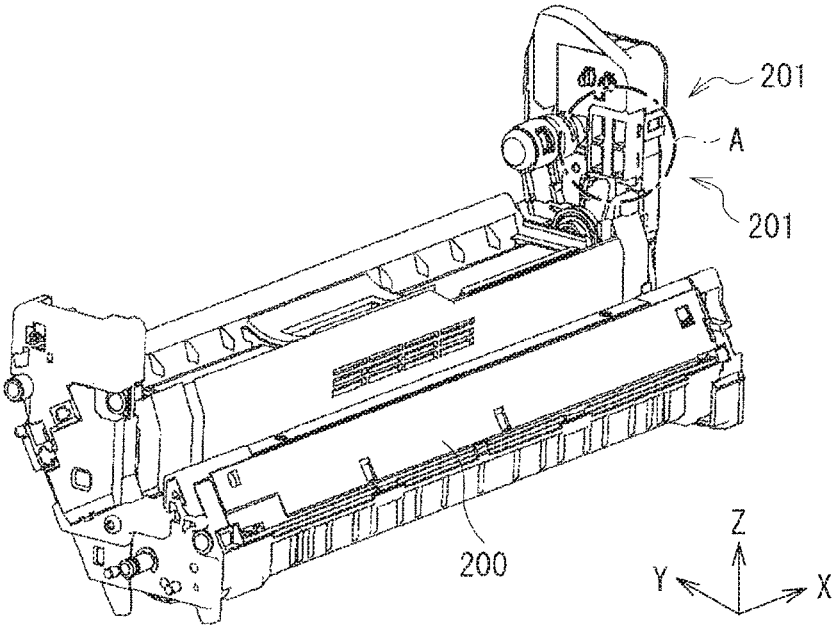
FIG. 2 is a perspective view of a configuration example of a development processor.
Figure 3:
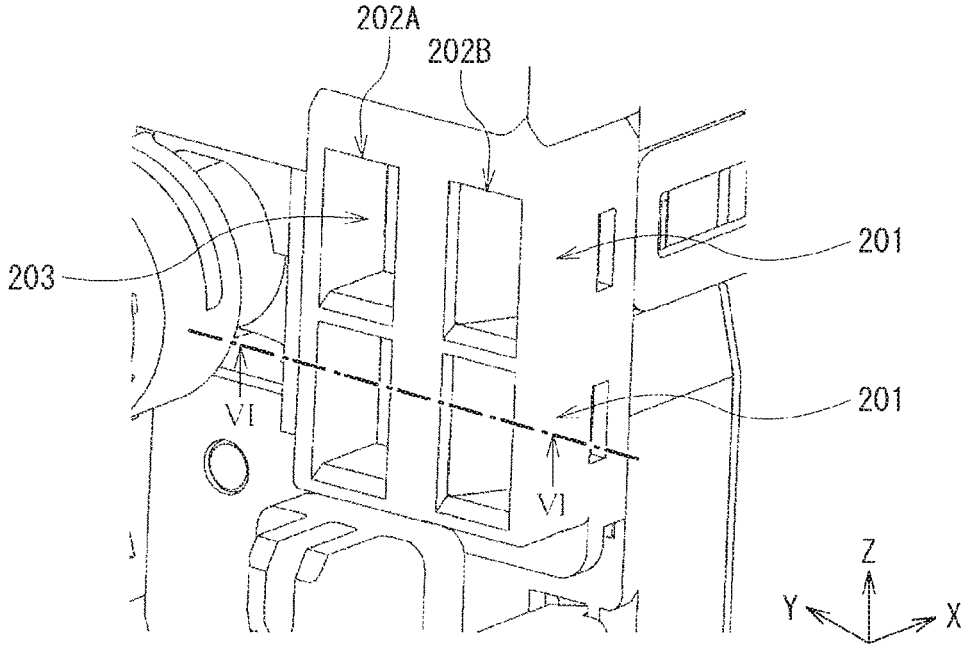
FIG. 3 is an enlarged perspective view of a part A of the configuration of the development processor illustrated in FIG. 2.
Figure 4:
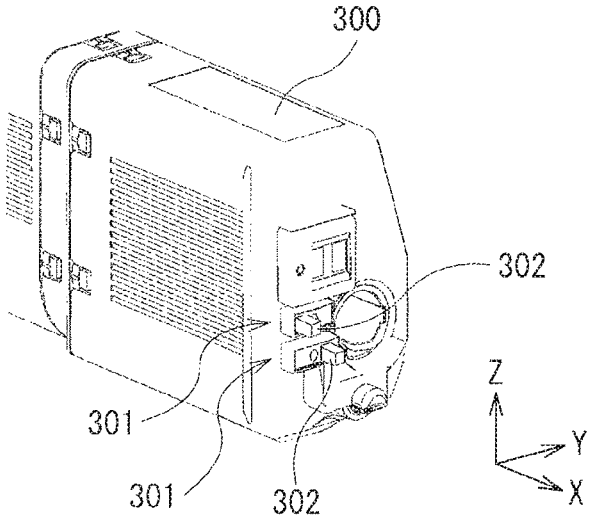
FIG. 4 is a perspective view of a configuration example of a developer container.

FIGS. 1 to 4 each illustrate a configuration of a development unit 100. The development unit 100 may correspond to a "development unit" in one specific but non-limiting embodiment of the technology. Specifically, FIG. 1 is a perspective view of the configuration of the development unit 100. FIG. 2 is a perspective view of a configuration of a development processor 200. FIG. 3 enlarges a part A of the perspective view of the configuration of the development processor 200 illustrated in FIG. 2. FIG. 4 is a perspective view of a configuration of a developer container 300.

The development unit 100 may include the development processor 200 and the developer container 300 as illustrated in FIGS. 1 to 4, for example. The developer container 300 is attachable to the development processor 200 in a detachable manner. FIG. 2 illustrates a state in which the developer container 300 is detached from the development processor 200.

[Development Processor]

The development processor 200 may correspond to the development processing unit according to the first example embodiment of the technology. The development processor 200 may correspond to an "attached unit" in one specific but non-limiting embodiment of the technology. The development processor 200 may attach, onto an electrostatic latent image, a developer 314 illustrated in FIG. 5 that is fed from the developer container 300 which will be described later.

In particular, referring to FIGS. 2 and 3, the development processor 200 may include an engaged section 201, for example. The engaged section 201 may be used upon attachment of the developer container 300 to the development processor 200. A detailed configuration of the development processor 200 will be described later.

[Developer Container]

The developer container 300 may correspond to the developer containing unit according to the first example embodiment of the technology. The developer container 300 may be a so-called toner cartridge, for example. The developer container 300 may correspond to an "attachable unit" in one specific but non-limiting embodiment of the technology. The developer container 300 may contain the foregoing developer 314.

In particular, referring to FIG. 4, the developer container 300 may include an engaging section 301, for example. The engaging section 301 may be directed to the attachment of the developer container 300 to the development processor 200. FIG. 4 illustrates only part of the developer container 300, i.e., the engaging section 301 and a part around the engaging section 301. A detailed configuration of the developer container 300 will be described later.

The development unit 100 may have an attachment mechanism that attaches the developer container 300 to the development processor 200 by means of the engaged section 201 and the engaging section 301 as described above. The engaged section 201 and the engaging section 301 may also have a function of aligning the development processor 200 and the developer container 300 to each other upon the attachment of the developer container 300 to the development processor 200. The attachment mechanism will be described later in detail.

<1-2. Detailed Configuration of Development Processor (Development Processing Unit)>

The detailed configuration of the development processor 200 is described below.

Figure 5:
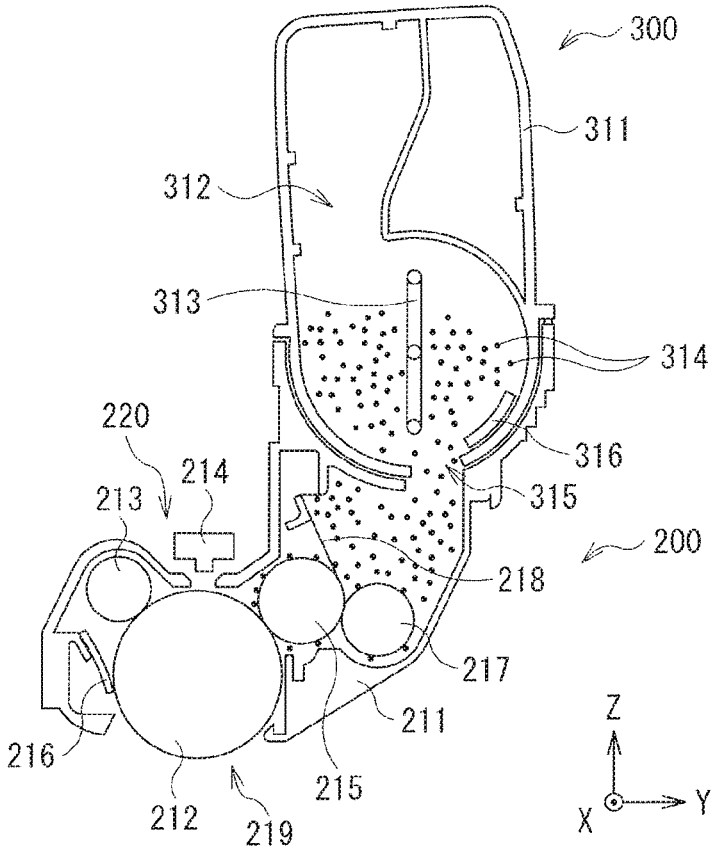
FIG. 5 is a plan view of an example of each of the configurations of the development processor and the developer container.

FIG. 5 illustrates a plan configuration in an YZ plane of each of the development processor 200 and the developer container 300. FIG. 5 illustrates a state in which the developer container 300 is attached to the development processor 200. FIG. 5 omits illustration of the engaged section 201.

Referring to FIG. 5, the development processor 200 may include a housing 211. The development processor 200 may include, inside the housing 211, a photosensitive drum 212, a charging roller 213, a light emitting diode (LED) head 214, a developing roller 215, a cleaning blade 216, a feeding roller 217, and a developing blade 218, for example.

The photosensitive drum 212 may be an organic photoreceptor that includes a cylindrical electrically-conductive supporting body and a photoconductive layer, for example. The photoconductive layer may cover an outer peripheral surface of the electrically-conductive supporting body. The photosensitive drum 212 may be rotatable with a drive source such as a motor. The electrically-conductive supporting body may be a metal pipe that includes a metal material such as aluminum, for example. The photoconductive layer may be a stack that includes layers including an electric charge generating layer and an electric charge transfer layer, for example. The housing 211 may have an opening 219 from which the photosensitive drum 212 is to be partially exposed, for example.

The charging roller 213 may include a metal shaft and an electrically-semiconductive epichlorohydrin rubber layer that covers an outer peripheral surface of the metal shaft, for example. The charging roller 213 may be rotatable with a drive source such as a motor. The charging roller 213 may be so pressed against the photosensitive drum 212 as to be in contact with the photosensitive drum 212, thereby charging the surface of the photosensitive drum 212.

The LED head 214 may be an exposure device that performs exposure of the surface of the photosensitive drum 212, and thereby forms an electrostatic latent image on the surface of the photosensitive drum 212. The LED head 214 may include an LED device and a lens array, for example. The LED device and the lens array may be so disposed that light (irradiation light) outputted from the LED device is imaged on the surface of the photosensitive drum 212. The housing 211 may have an opening 220 that guides the light outputted from the LED head 214 to the photosensitive drum 212, for example.

The developing roller 215 may include a metal shaft and an electrically-semiconductive urethane rubber layer that covers an outer peripheral surface of the metal shaft, for example. The developing roller 215 may be rotatable with a drive source such as a motor. The developing roller 215 may support the developer 314 that is fed from the feeding roller 217, and attach the fed developer 314 onto the electrostatic latent image formed on the surface of the photosensitive drum 212.

The cleaning blade 216 may scrape off unnecessary remains of the developer 314 that are present on the surface of the photosensitive drum 212. The cleaning blade 216 may extend in a direction intersecting a paper plane of FIG. 5, i.e., a direction substantially parallel to a rotation axis of the photosensitive drum 212, for example. The cleaning blade 216 may be so pressed against the photosensitive drum 212 as to be in contact with the photosensitive drum 212. The cleaning blade 216 may include a polymer material such as urethane rubber, for example.

The feeding roller 217 may include a metal shaft and an electrically-semiconductive foamed silicone sponge layer that covers an outer peripheral surface of the metal shaft, for example. The feeding roller 217 may be rotatable with a drive source such as a motor. The feeding roller 217 may feed the developer 314 to the surface of the developing roller 215 while being in contact with the developing roller 215 in a slidable manner.

The developing blade 218 may control the thickness of the developer 314 fed on the surface of the developing roller 215. The developing blade 218 may be so disposed as to be away from the developing roller 215 with a predetermined spacing in between. The thickness of the developer 314 may be controlled on the basis of the predetermined spacing. The developing blade 218 may include a metal material such as stainless steel, for example.

<1-3. Detailed Configuration of Developer Container (Developer Containing Unit)>

A detailed configuration of the developer container 300 is described below with reference to FIG. 5. FIG. 5 omits illustration of the engaging section 301.

Referring to FIG. 5, the developer container 300 may include a housing 311. The developer container 300 may include a stirring bar 313 inside the housing 311, for example. Specifically, the developer container 300 may include the stirring bar 313 in a containing chamber 312, for example.

The containing chamber 312 may contain the developer 314. The containing chamber 312 may have an outlet 315 from which the developer 314 is to be discharged to the development processor 200. The outlet 315 may be provided with a shutter 316 that is to be opened and closed utilizing a slide mechanism, for example. FIG. 5 illustrates an example case where the shutter 316 is open.

The stirring bar 313 may extend in a direction intersecting the paper plane of FIG. 5, for example. The stirring bar 313 may be rotatable around a rotation axis that extends in the direction in which the stirring bar 313 extends. The stirring bar 313 may stir the developer 314 contained in the containing chamber 312.

The developer 314 may be so-called toner, for example. A configuration of the developer 314 such as a color of the developer 314 is not particularly limited.

<1-4. Attachment Mechanism>

An attachment mechanism of the development unit 100 is described below.

The development unit 100 may allow for attachment of the developer container 300 to the development processor 200 by utilizing the engaged section 201 provided in the development processor 200 and the engaging section 301 provided in the developer container 300, as described above.

In particular, the development unit 100 may have a function of preventing attachment of the developer container 300 to the development processor 200 from being performed mistakenly. Specifically, upon the attachment of the developer container 300 to the development processor 200, when the engaging section 301 is brought into engagement with the engaged section 201 attachably and detachably, the state of the engaged section 201 changes in response to the engagement of the engaging section 301. The state, after the foregoing change, of the engaged section 201 upon the engagement of the engaging section 301 is maintained even after the engaging section 301 is detached from the engaged section 201. Some reasons that prevent attachment from being performed mistakenly will be described later in detail.

Figure 6:
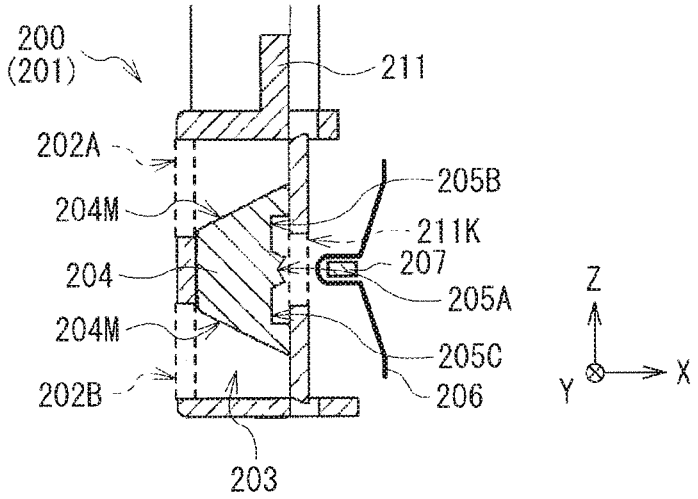
FIG. 6 is a cross-sectional view of a configuration example of a key part of the development processor.
Figure 7:
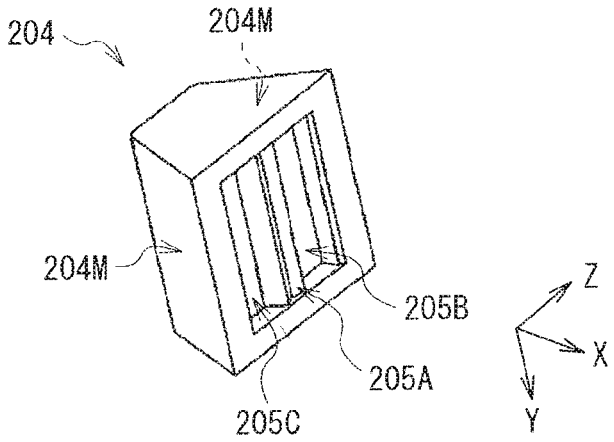
FIG. 7 is a perspective view of a configuration example of an insertion regulating member.
Figure 8:
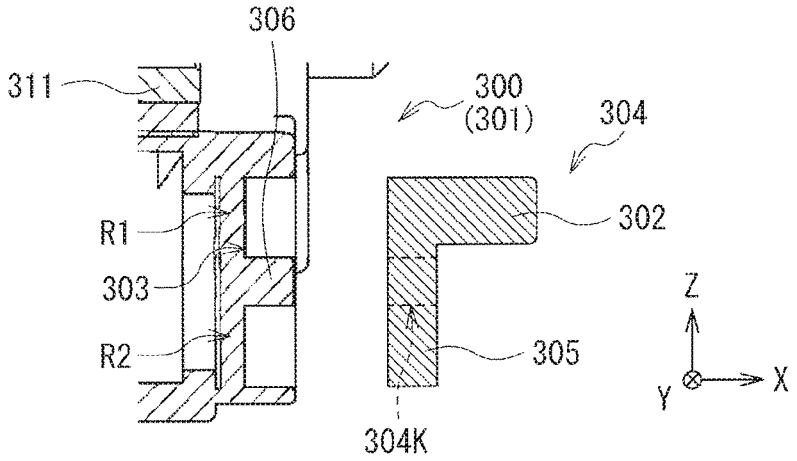
FIG. 8 is a cross-sectional view of a configuration example of a key part of the developer container.
Figure 9:
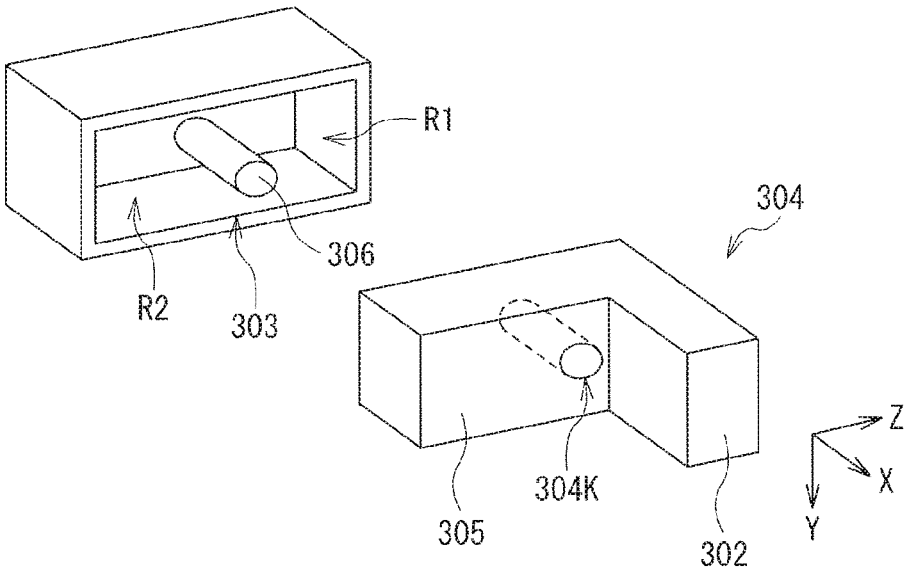
FIG. 9 is a perspective view of a configuration example of the key part of the developer container.

FIG. 6 illustrates a cross-sectional configuration, in an XZ plane, of a key part of the development processor 200. FIG. 7 is a perspective view of a configuration of an insertion regulating member 204. FIG. 8 illustrates a cross-sectional configuration in the XZ plane of a key part of the developer container 300. FIG. 9 is a perspective view of a configuration of a key part of the developer container 300. FIG. 6 illustrates a cross-section of the development processor 200 taken along a line VI-VI of FIG. 3.

[Engaged Section]

Referring to FIG. 6, the development processor 200 may have the engaged section 201 that is provided in part of the housing 211, for example. The engaged section 201 may include the insertion regulating member 204 and a fixing member 206, for example. The insertion regulating member 204 may be disposed inside an insertion chamber 203, for example. The fixing member 206 may be disposed outside the insertion chamber 203, for example. FIG. 6 illustrates a state in which the fixing member 206 is away from the insertion regulating member 204 for the sake of easier understanding of the configuration of the insertion regulating member 204.

The insertion chamber 203 may have space into which part of the developer container 300 is inserted upon the attachment of the developer container 300 to the development processor 200. Specifically, the part of the developer container 300 to be inserted into the insertion chamber 203 may be a protrusion 302 illustrated in FIG. 8 which will be described later. The insertion chamber 203 may have two openings 202A and 202B into which the protrusion 302 is insertable. The opening 202A may correspond to a "first opening" in one specific but non-limiting embodiment of the technology. The opening 202B may correspond to a "second opening" in one specific but non-limiting embodiment of the technology. The protrusion 302 may be insertable into the insertion chamber 203 from the opening 202A. The protrusion 302 may be also insertable into the insertion chamber 203 from the opening 202B. In other words, the protrusion 302 may be insertable into the insertion chamber 203 from either of the openings 202A and 202B.

The insertion regulating member 204 may have a function of regulating (permitting or prohibiting) insertion of the protrusion 302 into the insertion chamber 203, which may be called an insertion regulating function. Accordingly, the insertion regulating member 204 may be movable from an initial position to a regulating position in a direction (a Z direction) intersecting an insertion direction (an X direction) of the protrusion 302. Such a movement of the insertion regulating member 204 may be performed in response to the insertion of the protrusion 302 into the insertion chamber 203. The "insertion direction of the protrusion 302" is a direction in which the protrusion 302 is inserted, and is also referred to as a protruding direction or an extending direction of the protrusion 302 in other words.

Figure 10:
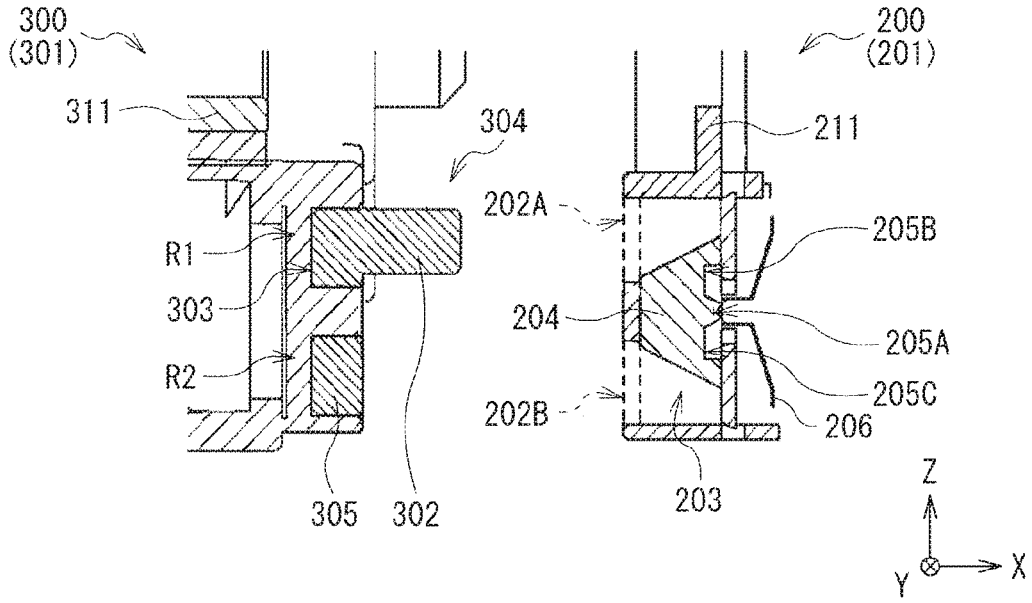
FIG. 10 is a cross-sectional diagram describing an example procedure of attachment of the developer container to the development processor.

When the insertion regulating member 204 is located at the "initial position", the insertion regulating member 204 may allow the protrusion 302 to be inserted into the insertion chamber 203 from the opening 202A, as illustrated in FIG. 10 which will be described later. In other words, when the insertion regulating member 204 is located at the initial position, the insertion regulating member 204 may not prevent the protrusion 302 from being inserted into the insertion chamber 203 from the opening 202A, i.e., to permit the protrusion 302 to be inserted into the insertion chamber 203 from the opening 202A.

It is to be noted that the protrusion 302 may be insertable into the insertion chamber 203 from either of the openings 202A and 202B as described above. Therefore, when the insertion regulating member 204 is located at the initial position, the insertion regulating member 204 may alternatively allow the protrusion 302 to be inserted into the insertion chamber 203 from the opening 202B.

Figure 11:
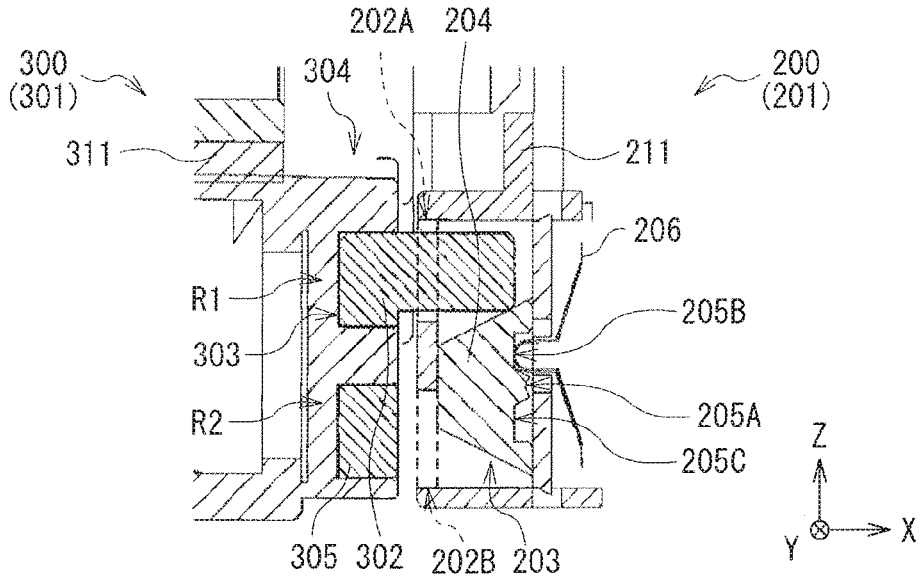
FIG. 11 is a cross-sectional diagram describing an example procedure of the attachment following the procedure illustrated in FIG. 10.
Figure 12:
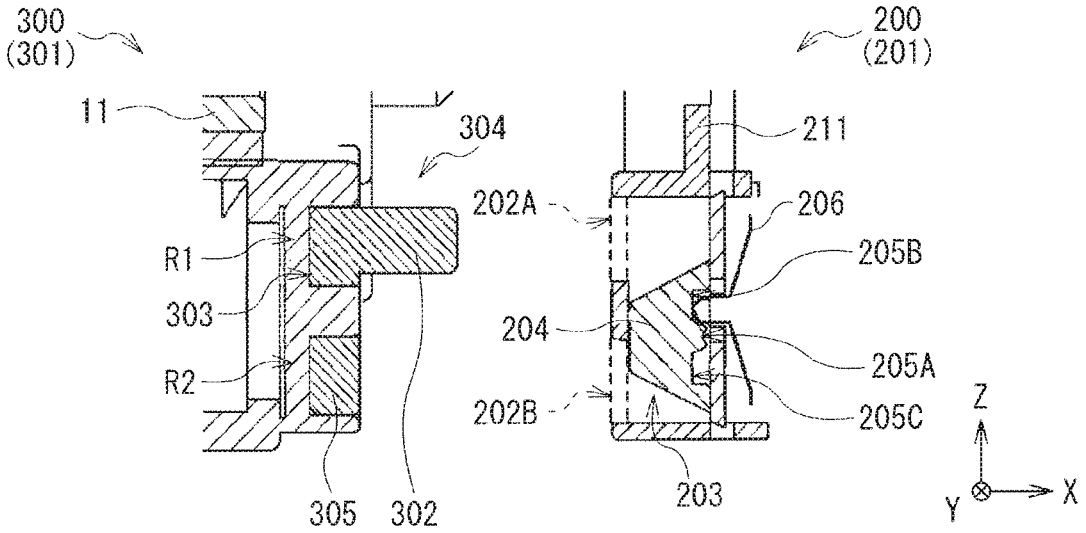
FIG. 12 is a cross-sectional diagram describing an example procedure of the attachment following the procedure illustrated in FIG. 11.
Figure 13:
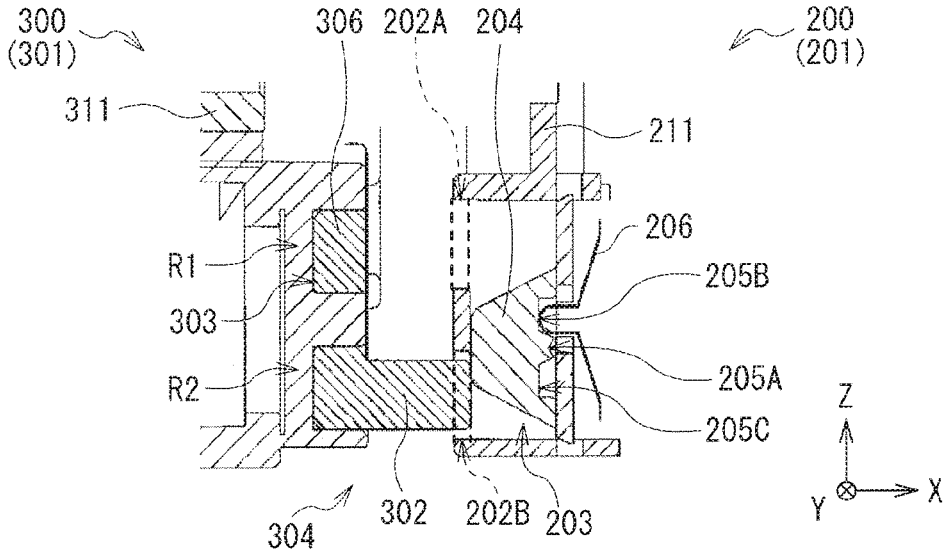
FIG. 13 is a cross-sectional diagram describing an example procedure of the attachment following the procedure illustrated in FIG. 12.

In contrast, when the insertion regulating member 204 is located at the "regulating position", the insertion regulating member 204 may prevent the protrusion 302 from being inserted into the insertion chamber 203 from the opening 202B, in response to the insertion of the protrusion 302 into the insertion chamber 203 from the opening 202A as illustrated in FIGS. 11 to 13 which will be described later. In other words, when the insertion regulating member 204 is located at the regulating position, the insertion regulating member 204 may prevent the protrusion 302 from being inserted into the insertion chamber 203 from the opening 202B after the protrusion 302 is inserted into the insertion chamber 203 from the opening 202A, i.e., the insertion regulating member 204 may prohibit the insertion of the protrusion 302 into the insertion chamber 203 from the opening 202B.

It is to be noted that the protrusion 302 may be insertable into the insertion chamber 203 from either of the openings 202A and 202B as described above. Therefore, when the insertion regulating member 204 is located at the regulating position, the insertion regulating member 204 may alternatively prevent the protrusion 302 from being inserted into the insertion chamber 203 from the opening 202A in response to the insertion of the protrusion 302 into the insertion chamber 203 from the opening 202A.

More specifically, the insertion regulating member 204 may have a particular shape in order to exhibit the insertion regulating function described above, for example. Specifically, the insertion regulating member 204 may include a pair of sloped surfaces 204M at positions corresponding to the respective openings 202A and 202B when the insertion regulating member 204 is located at the initial position. The pair of sloped surfaces 204M may be able to be brought into contact with the protrusion 302 and be sloped with respect to the insertion direction of the protrusion 302.

One reason why the insertion regulating member 204 includes the pair of sloped surfaces 204M is that the pair of sloped surfaces 204M makes it easier for the insertion regulating member 204 to move from the initial position to the regulating position by utilizing an insertion operation of the protrusion 302 upon the insertion of the protrusion 302 into the insertion chamber 203. Specifically, upon the insertion of the protrusion 302 into the insertion chamber 203, the protrusion 302 may be guided deeply into the insertion chamber 203 while being in contact with one of the sloped surfaces 204M. At this time, the insertion regulating member 204 may be pressed by the protrusion 302 in the direction (the Z direction) intersecting the insertion direction of the protrusion 302, and be thereby moved from the initial position to the regulating position.

As can be appreciated from FIG. 6, a direction in which the insertion regulating member 204 is pressed by the protrusion 302 depends on from which of the openings 202A and 202B the protrusion 302 is inserted into the insertion chamber 203.

Specifically, the insertion regulating member 204 may be pressed in the Z direction by the protrusion 302 when the protrusion 302 is inserted into the insertion chamber 203 from the opening 202A, for example. The Z direction may correspond to a downward direction in FIG. 6, for example. The insertion regulating member 204 may be therefore moved from the initial position to the regulating position in the downward direction.

In contrast, the insertion regulating member 204 may be pressed in the Z direction by the protrusion 302 when the protrusion 302 is inserted into the insertion chamber 203 from the opening 202B, for example. The Z direction may correspond to an upward direction in FIG. 6, for example.

The insertion regulating member 204 may be therefore moved from the initial position to the regulating position in the upward direction.

It is to be noted that a state of the pair of sloped surfaces 204M is not particularly limited as long as the state of the pair of sloped surfaces 204M allows the insertion regulating member 204 to move from the initial position to the regulating position by utilizing the contact of the protrusion 302 and the insertion regulating member 204 (one of the pair of sloped surfaces 204M) with each other.

Specifically, each of the pair of sloped surfaces 204M may be a flat surface, a convex curved surface, a concave curved surface, a convex bent surface, a concave bent surface, or a surface including two or more of the foregoing surfaces, for example. It is to be noted that one of the sloped surfaces 204M and the other of the sloped surfaces 204M may have the same state or may have states different from each other.

It may be preferable that each of the pair of sloped surfaces 204M be a flat surface in particular. One reason for this is that it is easier for the insertion regulating member 204 to move smoothly and stably by utilizing the contact of the protrusion 302 and the insertion regulating member 204 (one of the pair of sloped surfaces 204M) with each other.

For the foregoing reason, a cross-sectional shape of the insertion regulating member 204 is not particularly limited; however, it may be preferable that the cross-sectional shape of the insertion regulating member 204 be a substantially-trapezoidal shape having a shorter side on openings 202A and 202B side and a longer side on opposite side as illustrated in FIG. 6, for example. In this case, a width of the insertion regulating member 204, i.e., a dimension of the insertion regulating member 204 in the Z direction may gradually increase in a direction of being away from the openings 202A and 202B.

A three-dimensional shape of the insertion regulating member 204 is not particularly limited and may be any three-dimensional shape that includes the foregoing pair of sloped surfaces 204M. In this example, the three-dimensional shape of the insertion regulating member 204 may be a quadrangular prism shape having top and bottom surfaces that are each a substantially-trapezoidal shape as illustrated in FIG. 7, for example.

Further, the insertion regulating member 204 may have three fixing depressions 205A, 205B, and 205C on opposite side (on right side in FIG. 6) to side (left side in FIG. 6) on which the protrusion 302 is to be inserted into the insertion chamber 203, for example. The fixing depressions 205A, 205B, and 205C may be disposed in order in a moving direction (the Z direction) of the insertion regulating member 204. The moving direction of the insertion regulating member 204 is a direction in which the insertion regulating member 204 moves.

When the insertion regulating member 204 is located at the initial position, the fixing depression 205A may be used to fix the insertion regulating member 204 with the fixing member 206. The fixing depression 205A may correspond to a "first fixing depression" in one specific but non-limiting embodiment of the technology. The wording "fix" used in relation to the foregoing function of the fixing depression 205A may refer to temporarily fixing the position of the insertion regulating member 204, while suppressing unintentional variation in the position of the insertion regulating member 204 due to a cause such as impact and vibration. The temporal fixation of the position of the insertion regulating member 204 may allow the insertion regulating member 204 to be movable on an as-needed basis. This can be appreciated from the fact that the insertion regulating member 204 is movable from the initial position to the regulating position.

The fixing depression 205A may have a depth, i.e., a dimension in the X direction, that is smaller than a depth of each of the fixing depressions 205B and 205C, for example. This makes it easier for the insertion regulating member 204 located at the initial position to be movable on an as-needed basis.

A shape of the fixing depression 205A is not particularly limited. The wording the "shape of the fixing depression 205A" may refer to a three-dimensional shape of space that configures the fixing depression 205A. For example, the three-dimensional shape of the fixing depression 205A may be preferably a triangular prism shape in particular, as illustrated in FIG. 6. Specifically, it may be preferable that the depth of the fixing depression 205A gradually increase in a direction of being closer to the fixing depression 205A from the fixing depression 205B, and gradually increase in a direction of being closer to the fixing depression 205A from the fixing depression 205C. In other words, it may be preferable that an inner wall surface of the insertion regulating member 204, inside the fixing depression 205A be so sloped that the depth of the fixing depression 205A gradually increases in the direction of being closer to the fixing depression 205A from the fixing depression 205B. Further, it may be preferable that the inner wall surface, of the insertion regulating member 204, inside the fixing depression 205A be so sloped that the depth of the fixing depression 205A gradually increases in a direction of being closer to the fixing depression 205A from the fixing depression 205C. In this case, the inner wall surface may include two flat sloped surfaces, for example. One reason for this is that, upon being located in the initial state, it may be easier for the insertion regulating member 204 to slide in the moving direction of the insertion regulating member 204 by utilizing the slope of the foregoing inner wall surface, even when the fixing member 206 is inserted into the fixing depression 205A. This allows the insertion regulating member 204 to move easily and stably on an as-needed basis.

However, the foregoing inner wall surface of the insertion regulating member 204 may include a curved surface, or may include both the flat surface and the curved surface. Specifically, the three-dimensional shape of the fixing depression 205A may be a semi-cylindrical shape, a semi-spherical shape, or any other shape, for example.

The fixing depressions 205B and 205C may be provided on both sides of the fixing depression 205A in the moving direction of the insertion regulating member 204. When the insertion regulating member 204 is located at the regulating position, each of the fixing depressions 205B and 205C may be used to fix the insertion regulating member 204 with the fixing member 206. The fixing depressions 205B and 205C may correspond to a "pair of second fixing depressions" in one specific but non-limiting embodiment of the technology. The wording "fix" used in relation to the foregoing function of each of the fixing depressions 205B and 205C may refer to fully fixing the insertion regulating member 204, thereby substantially causing the insertion regulating member 204 to be difficult to move. This may be directed to preventing the insertion regulating member 204 from moving again after the insertion regulating member 204 moves from the initial position to the regulating position.

In order to substantially cause the insertion regulating member 204 that has moved to the regulating position to be difficult to move, each of the fixing depressions 205B and 205C may have a depth greater than the depth of the fixing depression 205A, for example. One reason for this is that an amount or a length by which the fixing member 206 is inserted into any one of the fixing depressions 205B and 205C may be greater, making it easier for the fixing member 206 to fix the insertion regulating member 204.

A three-dimensional shape of each of the fixing depressions 205B and 205C is not particularly limited. FIG. 6 illustrates an example case where the three-dimensional shape of each of the fixing depressions 205B and 205C is a quadrangular prism shape. More specifically, FIG. 6 illustrates an example case where the three-dimensional shape of each of the fixing depressions 205B and 205C is a quadrangular prism shape that has top and bottom surfaces each having a substantially-trapezoidal shape. The wording the "three-dimensional shape of each of the fixing depressions 205B and 205C" may refer to a three-dimensional shape of space that configures each of the fixing depressions 205B and 205C.

The fixing depressions 205A to 205C each may be provided in part of one surface of the insertion regulating member 204 on the opposite side to the side on which the protrusion 302 is to be inserted into the insertion chamber 203, for example, as illustrated in FIG. 7. The foregoing part of the surface of the insertion regulating member 204 may be a substantially-middle region of the foregoing surface of the insertion regulating member 204, for example.

The fixing member 206 may fix the insertion regulating member 204 as described above. Specifically, the fixing member 206 may temporarily fix the insertion regulating member 204 and fully fix the insertion regulating member 204. The fixing member 206 may be so fixed by an auxiliary fixing member 207 that the fixing member 206 is prevented from moving unintentionally in the moving direction of the insertion regulating member 204, for example. However, the auxiliary fixing member 207 may not be provided.

The fixing member 206 may be partially introduced inside the insertion chamber 203 from an opening 211K that is provided in the insertion chamber 203, for example. Further, the fixing member 206 may include a protruding part that protrudes toward the insertion regulating member 204, for example. The protruding part may be insertable into one of the three fixing depressions 205A to 205C provided in the insertion regulating member 204, for example.

Specifically, the fixing member 206 may be inserted into the fixing depression 205A when the insertion regulating member 204 is located at the initial position, for example. The insertion regulating member 204 located at the initial position may be thus fixed temporarily by the fixing member 206.

In contrast, the fixing member 206 may be inserted into one of the fixing depressions 205B and 205C when the insertion regulating member 204 is located at the regulating position, for example. The insertion regulating member 204 located at the regulating position may be thus fixed fully by the fixing member 206.

The fixing member 206 may include an elastic material that is elastically transformable, i.e., expandable and contractible, toward the insertion regulating member 204, for example. More specifically, the fixing member 206 may be a spring member such as a plate spring and a coil spring, for example. Accordingly, the fixing member 206 may also have a function as a biasing member that press the fixing member 206 against the insertion regulating member 204, in addition to a function of fixing the insertion regulating member 204, for example. FIG. 6 illustrates an example case where the fixing member 206 is the plate spring.

One reason why the fixing member 206 also has the function as the biasing member that presses the fixing member 206 against the insertion regulating member 204 is that making use of the biasing function allows the fixing member 206 to be easier to be inserted deeply into any one of the fixing depressions 205A to 205C. This makes it more difficult for the fixing member 206 after being inserted into any one of the fixing depressions 205A to 205C to be detached from the corresponding one of the fixing depressions 205A to 205C. This makes it easier for the fixing member 206 to fix the position of the insertion regulating member 204 in both the temporal fixation and the fully-performed fixation of the insertion regulating member 204.

[Engaging Section]

Referring to FIGS. 8 and 9, the developer container 300 may include the engaging section 301 that is provided in part of the housing 311, for example. The engaging section 301 may include a partially-protruding part, i.e., the protrusion 302, for example. The protrusion 302 may be disposed in one of two protrusion regions R1 and R2. The "two protrusion regions R1 and R2" may each be a position in which the protrusion 302 is disposed. Positions of the two protrusion regions R1 and R2 may correspond to the respective positions of the two openings 202A and 202B provided in the development processor 200. The protrusion 302 may correspond to a "protrusion" in one specific but non-limiting embodiment of the technology. The protrusion region R1 may correspond to a "first protrusion region" in one specific but non-limiting embodiment of the technology. The protrusion region R2 may correspond to a "second protrusion region" in one specific but non-limiting embodiment of the technology.

More specifically, the engaging section 301 may have a protrusion depression 303 in a region covering from the protrusion region R1 to the protrusion region R2, for example. The engaging section 301 may include a protrusion member 304, for example. The protrusion member 304 may be insertable into the protrusion depression 303, for example. One reason why the protrusion member 304 is described as being "insertable into the protrusion depression 303" is that the protrusion member 304 may be inserted into the protrusion depression 303 on an as-needed basis, i.e., the protrusion member 304 may be attachable to and detachable from the protrusion depression 303 on an as-needed basis. FIG. 8 illustrates a state where the protrusion member 304 is away from the protrusion depression 303 for the sake of easier understanding of a relationship between the protrusion depression 303 and the protrusion member 304.

The protrusion member 304 may be so inserted into the protrusion depression 303 that the protrusion member 304 partially protrudes in one of the two protrusion regions R1 and R2 and does not protrude in other regions, for example. Specifically, the protrusion member 304 may include a partially-protruding part, i.e., the protrusion 302 and a part to be embedded in the protrusion depression 303, i.e., an embedded part 305, for example. The protrusion 302 and the embedded part 305 may be coupled to each other, for example. Accordingly, a cross-sectional shape in an XZ plane of the protrusion member 304 may be a shape of the letter "L", for example.

When the protrusion member 304 is inserted into the protrusion depression 303, the embedded part 305 may be contained in the protrusion depression 303, and the protrusion 302 may protrude from the protrusion depression 303. It is thus possible to fill the protrusion depression 303 with part of the protrusion member 304, i.e., the embedded part 305, and to cause only other part of the protrusion member 304, i.e., only the protrusion 302 to protrude from the protrusion depression 303.

The engaging section 301 may include an alignment projection 306 inside the protrusion depression 303, for example. The protrusion member 304 may have an alignment opening 304K into which the alignment projection 306 is insertable, for example. One reason for this is that, when the protrusion member 304 is inserted into the protrusion depression 303, the protrusion member 304 may be aligned with respect to the protrusion depression 303 by utilizing the alignment projection 306, and the protrusion member 304 may be fixed while being inserted into the protrusion depression 303 by utilizing the alignment projection 306.

A three-dimensional shape of the alignment projection 306 is not particularly limited. However, the three-dimensional shape of the alignment projection 306 may be a cylindrical shape, a prism shape, or any other shape, for example. Non-limiting examples of the prism shape may include a quadrangular prism shape and a pentagonal prism shape. A three-dimensional shape of the alignment opening 304K is not particularly limited and may be any shape that allows the alignment projection 306 to be inserted into the alignment opening 304K. Specifically, the three-dimensional shape of the alignment opening 304K may be the same as the three-dimensional shape of the alignment projection 306 described above, or may be different from the three-dimensional shape of the alignment projection 306 described above.

However, in particular, the three-dimensional shape of the alignment opening 304K may be preferably a three-dimensional shape that allows the position at which the protrusion 302 is located to be switched optionally by means of the single protrusion member 304. In other words, the three-dimensional shape of the alignment opening 304K may be preferably a three-dimensional shape that allows the position at which the protrusion 302 is located to be freely switched between the protrusion region R1 and the protrusion region R2 by means of the single protrusion member 304. Specifically, the three-dimensional shape of the alignment opening 304K may be preferably a three-dimensional shape that allows for the following. That is, when the protrusion member 304 is so oriented that the protrusion 302 is disposed in the protrusion region R1, the thus-oriented protrusion member 304 is insertable into the protrusion depression 303, and when the protrusion member 304 is so oriented that the protrusion 302 is disposed in the protrusion region R2, the thus-oriented protrusion member 304 is also insertable into the protrusion depression 303.

In the foregoing example case, the position of the protrusion 302 may be variable by varying a state in which the protrusion member 304 is inserted into the protrusion depression 303. Specifically, when the protrusion member 304 is so inserted into the protrusion depression 303 that the protrusion 302 is located in the protrusion region R1, part of the protrusion member 304, i.e., the protrusion 302 may be allowed to protrude in the protrusion region R1, for example. In contrast, when the orientation of the protrusion member 304 is varied from that in the foregoing case, and the protrusion member 304 is thus so inserted into the protrusion depression 303 that the protrusion 302 is located in the protrusion region R2, part of the protrusion member 304, i.e., the protrusion 302 may be allowed to protrude in the protrusion region R2, for example. It is thus possible to freely set the position at which the protrusion member 304 partially protrudes by means of the single protrusion member 304.

It is to be noted that the protrusion member 304 may have an alignment depression instead of the alignment opening 304K, for example. Also in this example case where the protrusion member 304 has the alignment depression, the protrusion member 304 may be aligned and fixed due to insertion of the alignment projection 306 into the alignment depression.

The protrusion member 304 may include both the protrusion 302 and the embedded part 305. One reason for this is to prevent the developer container 300 from being unattachable to the development processor 200 unintentionally.

More in detail, in order to achieve the partial protrusion of part of the protrusion member 304, i.e., the protrusion 302, another protrusion member may be usable instead of the protrusion member 304, for example. Specifically, instead of the protrusion member 304 having the cross-sectional shape of the letter "L", a protrusion member having a rectangular cross-sectional shape that extends in the extending direction of the protrusion 302 may be used, for example. When such a protrusion member is used, part, of the protrusion depression 303, corresponding to the protrusion region R1 is filled with this protrusion member; however, other part of the protrusion depression 303 is not filled with this protrusion member.

The development processor 200 may have the configuration described above in which, after the protrusion 302 is inserted into the insertion chamber 203 from the opening 202A, the insertion of the protrusion 302 into the insertion chamber 203 from the opening 202B is prohibited by utilizing the insertion regulating function of the insertion regulating member 204, for example. Consideration is given below to an example case in which the developer container 300 is attached to the development processor 200 while the foregoing protrusion member having the rectangular cross-sectional shape is so inserted into the protrusion depression 303 that the protrusion 302 is located in the protrusion region R1, and the developer container 300 is thereafter detached from the development processor 200. In this case, another protrusion member may be so mistakenly inserted into the protrusion depression 303 that protrusion 302 is also located in the protrusion region R2, in addition to that the foregoing protrusion member is so inserted into the protrusion depression 303 that the protrusion 302 is located in the protrusion region R1. In such a state, when an attempt is made to attach the developer container 300 to the development processor 200, the developer container 300 is unattachable to the development processor 200. One reason for this is that the protrusion 302 located in the protrusion region R2 is not insertable into the insertion chamber 203 from the opening 202B.

In contrast, in the example case where the protrusion member 304 is used, the protrusion 302 may protrude in the protrusion region R1 and the embedded part 305 may fill the protrusion depression 303. This may prevent the protrusion 302 from being disposed in the protrusion region R2 mistakenly. As a result, the developer container 300 may be prevented from becoming unattachable to the development processor 200 due to the protrusion 302 mistakenly disposed in the protrusion region R2.

FIGS. 8 and 9 each illustrate an example case where the protrusion member 304 is so inserted into the protrusion depression 303 that the protrusion 302 is disposed in the protrusion region R1.

[Relationship Between Engaged Section and Engaging Section]

It is to be noted that the number of the engaged section 201 provided in the development processor 200 may be one, or two or more. In other words, when components including the insertion chamber 203 and the insertion regulating member 204 of the engaged section 201 is considered as a set, the number of set of the components including the insertion chamber 203 and the insertion regulating member 204 may be one, or two or more.

Similarly, the number of the engaging section 301 provided in the developer container 300 may be one, or two or more. In other words, when components including the protrusion depression 303 and the protrusion 302 of the engaging section 301 are considered as a set, the number of set of the components including the protrusion depression 303 and the protrusion 302 may be one, or two or more.

When the number of the engaged section 201 is two or more, a positional relationship between the two or more engaged sections 201 is not particularly limited. However, the two or more engaged sections 201 may be preferably arranged at any intervals on an as-needed basis, in particular. One reason for this is that a region occupied by the engaged sections 201 is thereby reduced, allowing for a reduction in volume of the engaged sections 201.

The positional relationship between the two or more engaged sections 201 is not particularly limited as described above. This is also applicable to the two or more engaging sections 301.

It is to be noted that the number of the engaged section 201 and the number of the engaging section 301 may be preferably equal to each other. One reason for this is that, a difference in number between the engaged section 201 and the engaging section 301 results in presence of the protrusion 302 that is not able to be inserted into the insertion chamber 203, making it more difficult to attach the developer container 300 to the development processor 200.

FIGS. 2 and 3 each illustrates an example case where the number of the engaged sections 201 is two, and the two engaged sections 201 are arranged in the Z direction. Further, FIG. 4 illustrates an example case where the number of the engaging section 301 is two and the two engaging sections 301 are arranged in the Z direction, which correspond to the number and the arrangement state of the engaged sections 201 described above.

[Configuration Combination of Engaging Section]

The development processor 200 may be provided with the two engaged sections 201 that are arranged in the Z direction as described above, for example. In this example case, the development processor 200 may be provided with the engaged section 201 in a first row and the engaged section 201 in a second row. The first row may be the upper row, and the second row may be the lower row. Each of the engaged sections 201 in the first and second rows may have the openings 202A and 202B and the insertion chamber 203, for example.

The developer container 300 may be provided with the two engaging sections 301 that are arranged in the Z direction as described above, for example. In this example case, the developer container 300 may be provided with the engaging section 301 in a first row and the engaging section 301 in a second row. The first row may be the upper row, and the second row may be the lower row. Each of the engaging sections 301 in the first and second rows may have the protrusion depression 303 and the protrusion 302, for example.

In the foregoing developer container 300, the protrusion 302 may be disposed in one of the protrusion regions R1 and R2 in the engaging section 301 in the first row. Similarly, the protrusion 302 may be disposed in one of the protrusion regions R1 and R2 in the engaging section 301 in the second row. Specifically, when the number of the engaging section 301 is two, the total number of the protrusion 302 to be used is two. Accordingly, there are four combinations for the two protrusions 302 to be inserted into one of the protrusion regions R1 and R2 in the first row and one of the protrusion regions R1 and R2 in the second row.

Combination 1: The protrusion 302 is disposed in the protrusion region R1 in the first row, and the protrusion 302 is disposed in the protrusion region R1 in the second row.

Combination 2: The protrusion 302 is disposed in the protrusion region R1 in the first row, and the protrusion 302 is disposed in the protrusion region R2 in the second row.

Combination 3: The protrusion 302 is disposed in the protrusion region R2 in the first row, and the protrusion 302 is disposed in the protrusion region R1 in the second row.

Combination 4: The protrusion 302 is disposed in the protrusion region R2 in the first row, and the protrusion 302 is disposed in the protrusion region R2 in the second row.

Accordingly, when the number of the engaging section 301 is two, a maximum of four types of developer containers 300 are identifiable by utilizing the foregoing four combinations. Specifically, the positions of the two protrusions 302 provided in each of the four developer containers 300 may be set to have any one of the foregoing four combinations, and thereby be different from each other. This allows for differentiation between the four developer containers 300 depending on the positions of the two protrusions 302 included in each of the developer containers 300, even when the four developer containers 300 have the same structure except for the positions of the two protrusions 302. FIG. 4 illustrates an example state in which the two protrusions 302 are disposed in Combination 2 described above.

<1-5. Operation>

An operation of the development unit 100 is described below.

The development unit 100 may perform an attachment regulating operation and a development operation by the procedure described below, for example.

[Attachment Regulating Operation]

FIGS. 10 to 13 each illustrate a cross-sectional configuration of the development processor 200 and the developer container 300 corresponding to FIGS. 6 to 8 and describe a procedure of attaching the developer container 300 to the development processor 200. FIGS. 10 to 13 each illustrate together the engaged section 201 and a part around the engaged section 201 out of the development processor 200 and the engaging section 301 and a part around the engaging section 301 out of the developer container 300, thereby describing the procedure of attaching the developer container 300 to the development processor 200 by utilizing the engaged section 201 and the engaging section 301. FIGS. 10 to 13 each illustrate, unlike FIG. 8, a state in which the protrusion member 304 is inserted into the protrusion depression 303.

The following description refers, as an example, to an attachment regulating operation with the engaging section 301 in the first row and the engaged section 201 in the first row.

In this example, the two protrusions 302 of the two engaging sections 301 are disposed in Combination 2 as described above. The protrusion 302 is therefore disposed in the protrusion region R1 in the engaging section 301 in the first row.

Further, the insertion regulating member 204 is located at the initial position in the engaged section 201. The fixing member 206 is therefore inserted into the fixing depression 205A in the engaged section 201. FIGS. 10 to 13 each illustrate, unlike FIG. 6 described above, a state in which the fixing member 206 is in contact with the insertion regulating member 204, i.e., in a state of being practically used. FIGS. 10 to 13 each omit illustration of the auxiliary fixing member 207.

Referring to FIG. 10, upon performing the attachment regulating operation, first, the development processor 200 and the developer container 300 may be so caused to face each other that the position of the engaged section 201 and the position of the engaging section 301 are aligned with each other. This is directed to the attachment of the developer container 300 to the development processor 200.

Thereafter, referring to FIG. 11, the developer container 300 may be pressed against the development processor 200. The protrusion 302 may be thereby inserted into the insertion chamber 203 from the opening 202A in the engaged section 201. In this case, the protrusion 302 may be pressed deeply into the insertion chamber 203 while the protrusion 302 is brought into contact with the sloped surface 204M that is located at a position corresponding to the opening 202A. Accordingly, the insertion regulating member 204 may be pressed downward by the protrusion 302. This may cause the insertion regulating member 204 to move from the initial position to the regulating position.

Upon the movement of the insertion regulating member 204 from the initial position to the regulating position, the fixing member 206 may remain stationary whereas the insertion regulating member 204 moves. Therefore, the fixing member 206 that has been inserted into the fixing depression 205A may be removed from the fixing depression 205A and thereafter be inserted into the fixing depression 205B.

In this example case, the fixing member 206 may be inserted into the fixing depression 205A when the insertion regulating member 204 is located at the initial position. However, the fixing depression 205A may have a relatively-small depth. Due to the relatively-small depth of the fixing depression 205A, the insertion regulating member 204 may be temporarily fixed by the fixing member 206 in accordance with the insertion of the fixing member 206 into the fixing depression 205A.

In this state, when the insertion regulating member 204 is pressed downward by the protrusion 302, force of the protrusion 302 that presses the insertion regulating member 204 may be greater than force of the fixing member 206 that temporarily fixes the insertion regulating member 204. Accordingly, the fixing member 206 may be removed from the fixing depression 205A. The insertion regulating member 204 may therefore move from the initial position toward the regulating position.

When the insertion regulating member 204 moves to the regulating position, the fixing member 206 that has been removed from the fixing depression 205A may be inserted into the fixing depression 205B. In this example case, the fixing depression 205B may have a depth greater than the depth of the fixing depression 205A. It may be therefore more difficult for the fixing member 206 that is inserted into the fixing depression 205B to be removed from the fixing depression 205B. Accordingly, the insertion regulating member 204 may be fully fixed by the fixing member 206.

As a result, the insertion regulating member 204 may move to the position corresponding to the opening 202B, i.e., the regulating position, partially blocking the opening 202B.

Lastly, referring to FIG. 12, when the protrusion 302 that has been inserted into the insertion chamber 203 is removed from the insertion chamber 203, the insertion regulating member 204 may be fully fixed by the fixing member 206 as described above. Therefore, a state in which the insertion regulating member 204 is located at the regulating position may be maintained even after the developer container 300 is detached from the development processor 200.

The attachment regulating operation may be thus completed. After the completion of the attachment regulating operation, the insertion of the protrusion 302 into the insertion chamber 203 from the opening 202A may be permitted in the engaged section 201, whereas the insertion of the protrusion 302 into the insertion chamber 203 from the opening 202B is prohibited in the engaged section 201.

Specifically, referring to FIG. 13, the protrusion 302 may be disposed in the protrusion region R2 in the engaging section 301 in the first row in the developer container 300. When an attempt is made to attach the developer container 300 in the foregoing state to the development processor 200, the protrusion 302 is not insertable into the insertion chamber 203 from the opening 202B.

The attachment regulating operation described above may be similarly performed for the engaging section 301 in the second row and the engaged section 201 in the second row.

Specifically, the protrusion 302 may be disposed in the protrusion region R2 in the engaging section 301 in the second row, for example. The protrusion 302 thus disposed may be inserted into the insertion chamber 203 from the opening 202B. Accordingly, after the developer container 300 is detached from the development processor 200, the insertion of the protrusion 302 into the insertion chamber 203 from the opening 202B may be permitted in the engaged section 201 in the second row, whereas the insertion of the protrusion 302 into the insertion chamber 203 from the opening 202A is prohibited in the engaged section 201 in the second row.

Accordingly, when an attempt is made to attach, to the development processor 200, another developer container 300 that has an arrangement combination of the two protrusions 302 different from that of the developer container 300 used in performing the foregoing attachment regulating operation, such a developer container 300 having different arrangement combination of the two protrusions 302 is not attachable to the development processor 200. This prevents an inappropriate developer container 300 from being mistakenly attached to the development processor 200.

[Development Operation]

Upon performing the development operation, first, the charging roller 213 in the development processor 200 may apply a direct-current voltage to the surface of the photosensitive drum 212 while rotating, in response to the rotation of the photosensitive drum 212. The surface of the photosensitive drum 212 may be thereby electrically charged in an even manner.

Thereafter, the LED head 214 may apply light to the surface of the photosensitive drum 212 in accordance with an image signal. This may cause attenuation of a surface electric potential, i.e. light attenuation, in a part irradiated with light on the surface of the photosensitive drum 212. Accordingly, an electrostatic latent image may be formed on the surface of the photosensitive drum 212.

In the developer container 300, the developer 314 contained in the containing chamber 312 may be discharged toward the feeding roller 217.

The feeding roller 217 may rotate after application of a voltage to the feeding roller 217. This may cause the developer 314 to be fed from the developer container 300 to the surface of the feeding roller 217.

The developing roller 215 may rotate while being so pressed against the feeding roller 217 as to be in contact with the feeding roller 217, after application of a voltage to the development roller 215. This may cause the developer 314 fed on the surface of the feeding roller 217 to be adsorbed onto the surface of the developing roller 215. The developer 314 may be therefore conveyed by utilizing the rotation of the developing roller 215. At this time, part of the developer 314 adsorbed onto the surface of the developing roller 215 may be removed by the developing blade 218. This may allow the thickness of the developer 314 adsorbed onto the surface of the developing roller 215 to be even.

The developer 314 adsorbed onto the surface of developing roller 215 may be transferred onto the surface of the photosensitive drum 212 after the photosensitive drum 212 rotates while being so pressed against the developing roller 215 as to be in contact with the development roller 215. This may cause the developer 314 to be attached onto the surface of the photosensitive drum 212, i.e., the electrostatic latent image. The developer image may be thus formed.

<1-6. Workings and Effects>

The development unit 100 may include the attached unit (the development processor 200) having the engaged section 201 and the attachable unit (the developer container 300) having the engaging section 301. Upon the attachment of the developer container 300 to the development processor 200, when the engaging section 301 is brought into engagement with the engaged section 201 attachably and detachably, the state of the engaged section 201 changes in response to the engagement of the engaging section 301. The state of the engaged section 201 upon the engagement of the engaging section 301, i.e., the state of the engaged section 201 after the change is maintained even after the engaging section 301 is detached from the engaged section 201. In this case, an inappropriate developer container 300 is prevented from being attached to the development processor 200 after the insertion regulating member 204 has moved to the regulating position as described above. It is therefore possible to prevent the developer container 300 from being mistakenly attached to the development processor 200.

This is also applicable to a particular example case where a plurality of developer containers 300 having similar structures except for a difference in positions of the protrusions 302 are used utilizing the engaged sections 201 and the engaging sections 301 described above. In other words, it is also possible to prevent the plurality of developer containers 300 having such structures from being mistakenly attached to the development processors 200.

In particular, it is possible to sufficiently prevent an inappropriate developer container 300 from being attached to the development processor 200 under the conditions that: the engaging section 301 includes the protrusion 302 that is disposed in one of the protrusion regions R1 and R2; the engaged section 201 includes the insertion regulating member 204 inside the insertion chamber 203 having the openings 202A and 202B; and the insertion regulating member 204 is movable from the initial position to the regulating position.

Moreover, concerning the engaged section 201, it is easier for the insertion regulating member 204 to move from the initial position to the regulating position when the insertion regulating member 204 includes the pair of sloped surfaces 204M at positions corresponding to the respective openings 202A and 202B in a state where the insertion regulating member 204 is located at the initial position. It is therefore possible to achieve a higher effect.

Moreover, unintentional movement of the insertion regulating member 204 is suppressed when the engaged section 201 includes the fixing member 206 that fixes the insertion regulating member 204. It is therefore possible to achieve a higher effect. In this case, the insertion regulating member 204 is fixed temporarily and fully by the fixing member 206 under the conditions that: the insertion regulating member 204 has the fixing depression 205A having a relatively-smaller depth and the fixing depressions 205B and 205C each having a relatively-greater depth; and the fixing member 206 is insertable into any of the fixing depressions 205A to 205C. It is therefore possible to achieve a higher effect. Further, it is easier for the fixing member 206 that has been inserted into the fixing depression 205A to be removed from the fixing depression 205A on an as-needed basis when the inner wall surface, of the insertion regulating member 204, inside the fixing depression 205A is so sloped that the depth of the fixing depression 205A gradually increases in a direction of being closer to the fixing depression 205A from each of the pair of fixing depressions 205B and 205C. It is therefore possible to achieve a higher effect.

It is easier for the fixing member 206 to fix the insertion regulating member 204 when the fixing member 206 is biased toward the insertion regulating member 204. It is therefore possible to achieve a higher effect.

Concerning the engaging section 301, it is avoidable to mistakenly dispose the protrusion 302 when the protrusion member 304 that is so inserted into the protrusion depression 303 as to partially protrude in one of the protrusion region R1 and the protrusion region R2 and not to protrude in other region. The protrusion depression 303 is provided in a region covering from the protrusion region R1 to the protrusion region R2. It is therefore possible to achieve a higher effect.

It is to be noted that, when the number of the engaged section 201 is two or more and the number of the engaging section 301 is two or more, the number of the combinations of arranging the plurality of protrusions 302 increases. The combinations of arranging the protrusions 302 are utilizable for identifying the respective developer containers 300. It is therefore possible to prevent the greater number of developer containers 300 from being mistakenly attached to the development processors 200. In particular, when the n-number of engaging sections 301 are provided, the number of the combinations of arranging the protrusions 302 that are utilizable for identifying the developer containers 300 is $2^n$, where "n" is an integer. To give a specific example, when two engaging sections 301 are provided, the number of arranging the protrusions 302 is 4 ($2^2$=4). To give another specific example, when three engaging sections 301 are provided, the number of arranging the protrusions 302 is 8 ($2^3$=8).

<2. Development Unit: Second Example Embodiment>

A development unit according to a second example embodiment of the technology is described below.

It is to be noted that a developer containing unit according to the second example embodiment of the technology and a development processing unit according to the second example embodiment of the technology may be applied to the development unit described below, for example. The developer containing unit and the development processing unit according to the second example embodiment are described together with the development unit according to the second example embodiment below.

<2-1. Configuration>

The development unit 100 according to the present example embodiment may have a configuration similar to that of the development unit 100 according to the first example embodiment except that the development processor 200 includes an engaged section 220 instead of the engaged section 201.

Figure 14:
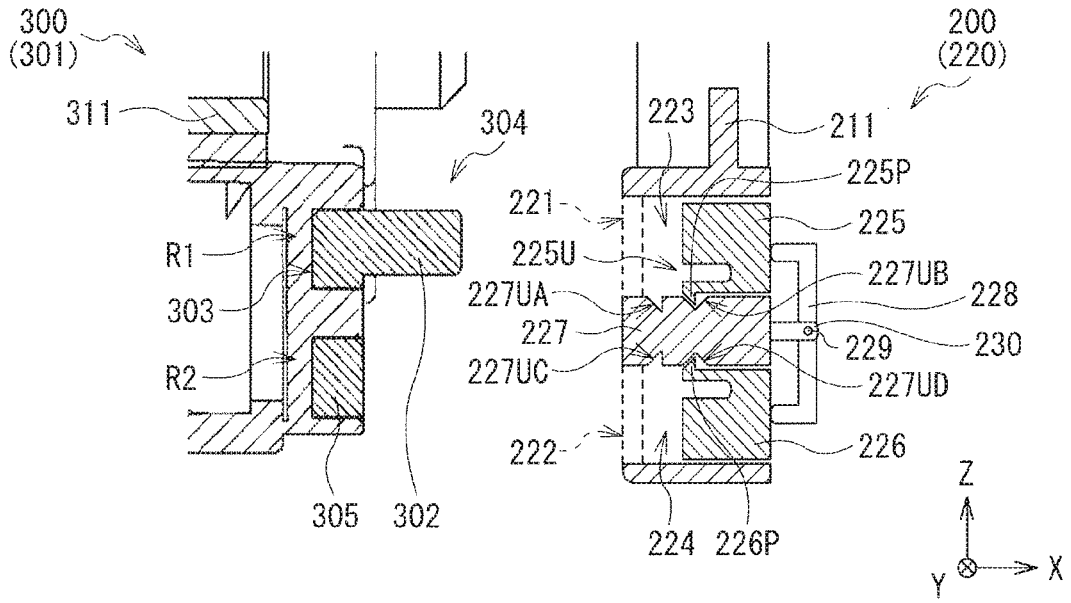
FIG. 14 is a cross-sectional view of a configuration example of a key part of a development unit according to a second example embodiment of the technology.

FIG. 14 illustrates a cross-sectional configuration on an XZ plane of a key part of the development processor 200, and corresponds to FIG. 10.

Referring to FIG. 14, the engaged section 220 provided in the development processor 200 may include an insertion chamber 223, an insertion chamber 224, an insertion regulating member 225, an insertion regulating member 226, a separating member 227, and a movement controlling member 228, for example. The insertion chamber 223 may have an opening 221. The insertion chamber 224 may have an opening 222. The insertion regulating member 225 may be disposed inside the insertion chamber 223. The insertion regulating member 226 may be disposed inside the insertion chamber 224. The separating member 227 may be disposed between the insertion chambers 223 and 224. The movement controlling member 228 may be disposed outside the insertion chambers 223 and 224. The insertion chamber 223 may correspond to a "first insertion chamber" in one specific but non-limiting embodiment of the technology. The insertion chamber 224 may correspond to a "second insertion chamber" in one specific but non-limiting embodiment of the technology. The insertion regulating member 225 may correspond to a "first insertion regulating member" in one specific but non-limiting embodiment of the technology. The insertion regulating member 226 may correspond to a "second insertion regulating member" in one specific but non-limiting embodiment of the technology. The opening 221 may correspond to a "first opening" in one specific but non-limiting embodiment of the technology. The opening 222 may correspond to a "second opening" in one specific but non-limiting embodiment of the technology.

The insertion chamber 223 may have space into which part of the developer container 300 is inserted from the opening 221 upon the attachment of the developer container 300 to the development processor 200. Specifically, the part of the developer container 300 to be inserted into the insertion chamber 223 may be the protrusion 302. The insertion chamber 224 may have space into which part of the developer container 300 is inserted from the opening 222 upon the attachment of the developer container 300 to the development processor 200. Specifically, the part of the developer container 300 to be inserted into the insertion chamber 224 may be the protrusion 302. In other words, the protrusion 302 may be insertable into the insertion chamber 223 from the opening 221, and may be also insertable into the insertion chamber 224 from the opening 222.

The insertion regulating member 225 may have a function of regulating (permitting or prohibiting) insertion of the protrusion 302 into the insertion chamber 223, which may be called an insertion regulating function. Accordingly, when the protrusion 302 is inserted into the insertion chamber 224 from the opening 222, the insertion regulating member 226 may be so pressed by the inserted protrusion 302 as to move backward. In response to the backward movement of the insertion regulating member 226, the insertion regulating member 225 may be so pressed by the movement controlling member 228 as to move forward, thereby exhibiting the foregoing insertion regulating function. The insertion regulating member 225 may be thus movable in the insertion direction (the X direction) of the protrusion 302. In particular, the insertion regulating member 225 may be movable from the initial position to the regulating position.

It is to be noted that moving "backward" may refer to moving to the right side in FIG. 14, and moving "forward" may refer to moving to the left side in FIG. 14.

The insertion regulating member 226 may have a function of regulating (permitting or prohibiting) insertion of the protrusion 302 into the insertion chamber 224, which may be called an insertion regulating function. When the protrusion 302 is inserted into the insertion chamber 223 from the opening 221, the insertion regulating member 225 may be so pressed by the inserted protrusion 302 as to move backward. In response to the backward movement of the insertion regulating member 225, the insertion regulating member 226 may be so pressed by the movement controlling member 228 as to move forward, thereby exhibiting the foregoing insertion control function. The insertion regulating member 226 may be thus movable in the insertion direction (the X direction) of the protrusion 302. In particular, the insertion regulating member 226 may be movable from the initial position to the regulating position.

As can be appreciated from FIG. 14, which of the insertion regulating members 225 and 226 is pressed by the protrusion 302 may depend on whether the protrusion 302 is inserted into the insertion chamber 223 from the opening 221 or whether the protrusion 302 is inserted into the insertion chamber 224 from the opening 222.

When the insertion regulating members 225 and 226 are located at the initial positions, the insertion regulating members 225 and 226 may allow the protrusion 302 to be inserted into the insertion chamber 223 from the opening 221, as illustrated in FIG. 14. In other words, when the insertion regulating members 225 and 226 are located at the initial positions, the insertion regulating member 225 may not prevent the protrusion 302 from being inserted into the insertion chamber 223 from the opening 221, i.e., the insertion regulating member 225 may permit the protrusion 302 to be inserted into the insertion chamber 223 from the opening 221.

It is to be noted that the protrusion 302 may be insertable into the insertion chamber 223 from the opening 221 and may be also insertable into the insertion chamber 224 from the opening 222 as described above. Therefore, when the insertion regulating members 225 and 226 are located at the initial positions, the insertion regulating members 225 and 226 may alternatively allow the protrusion 302 to be inserted into the insertion chamber 224 from the opening 222.

Figure 15:
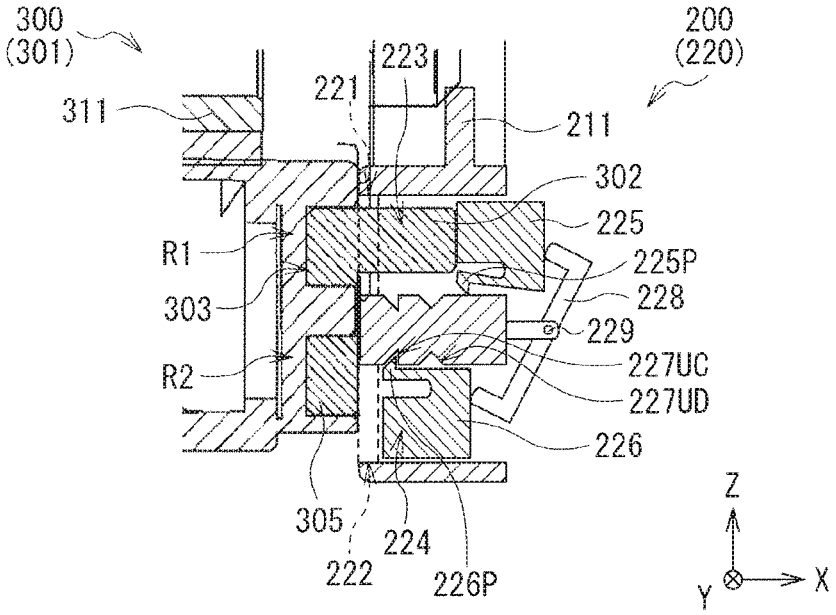
FIG. 15 is a cross-sectional diagram describing an example procedure of attachment of the developer container to the development processor.
Figure 16:
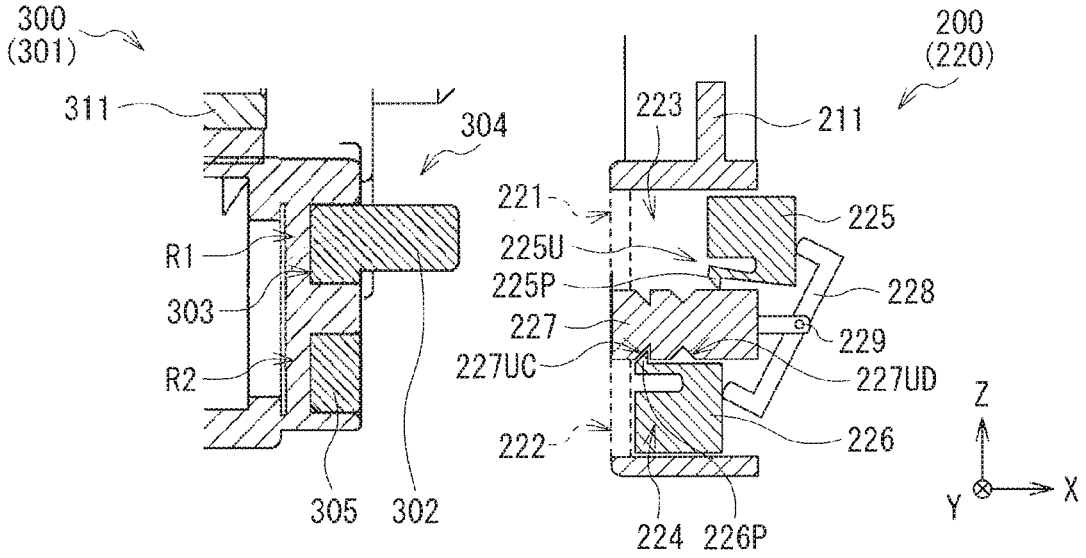
FIG. 16 is a cross-sectional diagram describing an example procedure of the attachment following the procedure illustrated in FIG. 15.
Figure 17:
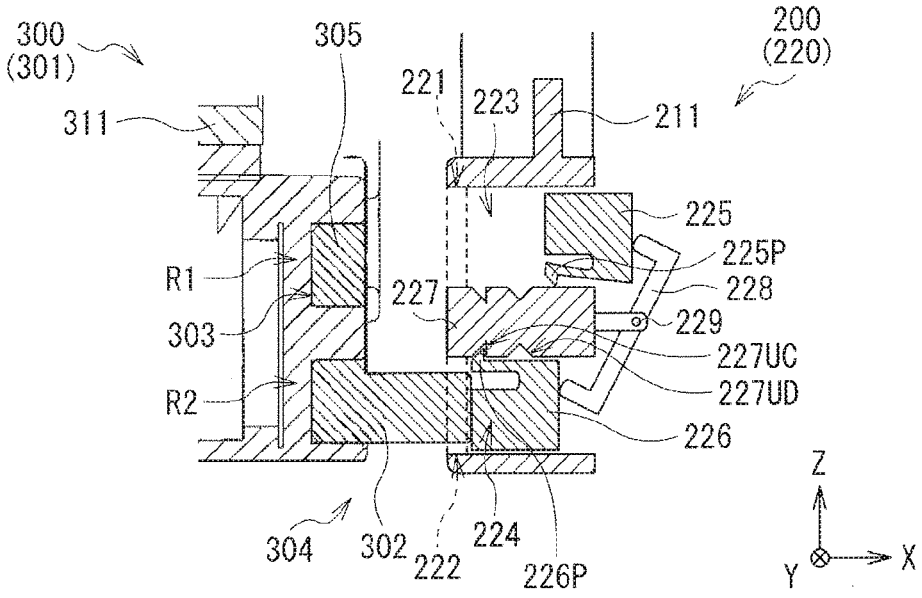
FIG. 17 is a cross-sectional diagram describing an example procedure of the attachment following the procedure illustrated in FIG. 16.

In contrast, when the insertion regulating members 225 and 226 are located at the "regulating positions", the insertion regulating members 225 and 226 may prevent the protrusion 302 from being inserted into the insertion chamber 224 from the opening 222, in response the insertion regulating member 225 being pressed by the protrusion 302 that has been inserted into the insertion chamber 223 from the opening 221 as illustrated in FIGS. 15 to 17 which will be described later. In other words, when the insertion regulating members 225 and 226 are located at the regulating positions, the insertion regulating member 226 may prevent the protrusion 302 from being inserted into the insertion chamber 224 from the opening 222 after the protrusion 302 is inserted into the insertion chamber 223 from the opening 221, i.e., the insertion regulating member 226 may prohibit the insertion of the protrusion 302 into the insertion chamber 224 from the opening 222.

It is to be noted that the protrusion 302 may be insertable into the insertion chamber 223 from the opening 221, and may be also insertable into the insertion chamber 224 from the opening 222 as described above. Therefore, when the insertion regulating members 225 and 226 are located at the regulating positions, the insertion regulating members 225 and 226 may prevent the protrusion 302 from being inserted into the insertion chamber 223 from the opening 221 in response to the insertion regulating member 226 being pressed by the protrusion 302 that has been inserted into the insertion chamber 224 from the opening 222.

More specifically, the insertion regulating member 225 may have a particular shape in order to exhibit the insertion regulating function described above, for example. Specifically, the insertion regulating member 225 may have a cross-sectional shape in the XZ plane that is substantially rectangular and includes a projection 225P as illustrated in FIG. 14, for example. The projection 225P may be projected in a direction of being closer to the separating member 227. The projection 225P may correspond to a "first projection" in one specific but non-limiting embodiment of the technology.

One reason why the insertion regulating member 225 includes the projection 225P is that the projection 225P is inserted into any of fixing depressions 227UA and 227UB provided in the separating member 227 and the insertion regulating member 225 is fixed thereby. The fixing depressions 227UA and 227UB will be described later.

Specifically, for example, when the insertion regulating member 225 is located at the initial position, the projection 225P may be inserted into the fixing depression 227UB. The insertion regulating member 225 may be thereby temporarily fixed by the projection 225P while being located at the initial position.

In contrast, for example, when the insertion regulating member 225 is located at the regulating position, the projection 225P may be insertable into the fixing depression 227UA. The insertion regulating member 225 may be thereby fully fixed by the projection 225P while being located at the regulating position.

A cross-sectional shape in the XZ plane of the projection 225P is not particularly limited. However, it may be preferable in particular that a height of the projection 225P gradually increase in the insertion direction of the protrusion 302. Specifically, it may be preferable that a three-dimensional shape of the projection 225P have a sloped surface having a height that gradually increases in the insertion direction of the protrusion 302. One reason for this is that it is easier for the projection 225P to be removed from the fixing depression 227UB on an as-needed basis and it is more difficult for the projection 225P to be removed from the fixing depression 227UA on an as-needed basis. The foregoing sloped surface may be a flat surface, a curved surface, or a surface including both the flat surface and the curved surface, for example.

It is to be noted that the insertion regulating member 225 may preferably have a deformation depression 225U on side on which the protrusion 302 is inserted, for example. One reason for this is that it is easier for the projection 225P and a part around the projection 225P out of the insertion regulating member 225 to be so deformed as to be away from the separating member 227 in a direction (the Z direction) intersecting the insertion direction of the protrusion 302. Such deformation of the projection 225P and the part around the projection 225P may be performed utilizing the deformation depression 225U. Accordingly, the insertion regulating member 225 may be biased toward the separating member 227 by utilizing a restoration force that is generated upon the deformation of the insertion regulating member 225. This may make it easier for the insertion regulating member 225 to move while being in contact with the separating member 227. It may be therefore easier for the projection 225P to be inserted into any of the fixing depressions 227UA and 227UB.

Moreover, the insertion regulating member 226 may have a shape similar to the shape of the insertion regulating member 225 in order to exhibit the insertion regulating function described above, for example. Specifically, the insertion regulating member 226 may have a cross-sectional shape in the XZ plane that is substantially rectangular and includes a projection 226P as illustrated in FIG. 14, for example. The projection 226P may be projected in a direction of being closer to the separating member 227. One reason why the insertion regulating member 226 includes the projection 226P is that the projection 226P is inserted into any of fixing depressions 227UC and 227UD provided in the separating member 227 and the insertion regulating member 226 is fixed thereby. The projection 226P may correspond to a "second projection" in one specific but non-limiting embodiment of the technology.

Specifically, for example, when the insertion regulating member 226 is located at the initial position, the projection 226P may be inserted into the fixing depression 227UD. The insertion regulating member 226 may be thereby temporarily fixed by the projection 226P while being located at the initial position.

In contrast, for example, when the insertion regulating member 226 is located at the regulating position, the projection 226P may be insertable into the fixing depression 227UC. The insertion regulating member 226 may be thereby fully fixed by the projection 226P while being located at the regulating position.

A cross-sectional shape in the XZ plane of the projection 226P is not particularly limited. However, it may be preferable in particular that the cross-sectional shape of the projection 226P be similar to the cross-sectional shape of the projection 225P. Specifically, it may be preferable that a height of the projection 226P gradually increase in the insertion direction of the protrusion 302. Further, it may be preferable that a three-dimensional shape of the projection 226P have a sloped surface having a height that gradually increases in the insertion direction of the protrusion 302. One reason for this is that it is easier for the projection 226P to be removed from the fixing depression 227UD on an as-needed basis and it is more difficult for the projection 226P to be removed from the fixing depression 227UC on an as-needed basis.

It is to be noted that the insertion regulating member 226 may preferably have a deformation depression 226U on side on which the protrusion 302 is inserted, for example, as with the insertion regulating member 225. One reason for this is that the insertion regulating member 226 may be biased toward the separating member 227 utilizing a restoration force that is generated upon the deformation of the insertion regulating member 226. This may make it easier for the projection 226P to be inserted into any of the fixing depressions 227UC and 227UD.

The separating member 227 may be disposed between the insertion chambers 223 and 224. The insertion chambers 223 and 224 may be therefore separated from each other by the separating member 227.

The separating member 227 may have the two fixing depressions 227UA and 227UB on the insertion regulating member 225 side, for example. The fixing depressions 227UA and 227UB may be provided in order from side on which the protrusion 302 is inserted into the insertion chamber 223, for example. The projection 225P may be insertable into the fixing depression 227UB when the insertion regulating member 225 is located at the initial position. Further, the projection 225P may be insertable into the fixing depression 227UA when the insertion regulating member 225 is located at the regulating position. The fixing depression 227UA may correspond to the "second fixing depression" in one specific but non-limiting embodiment of the technology. The fixing depression 227UB may correspond to the "first fixing depression" in one specific but non-limiting embodiment of the technology.

When the insertion regulating member 225 is located at the initial position, the fixing depression 227UB may be used to fix the insertion regulating member 225 by utilizing insertion of the projection 225P into the fixing depression 227B. The wording "fix" used in relation to the foregoing function of the fixing depression 227UB may refer to temporarily fixing the position of the insertion regulating member 225, while suppressing unintentional variation of the position of the insertion regulating member 225 due to a cause such as impact and vibration. The temporal fixation of the position of the insertion regulating member 225 may allow the insertion regulating member 225 to be movable on an as-needed basis. This can be appreciated from the fact that the insertion regulating member 225 is movable from the initial position to the regulating position.

A shape of the fixing depression 227UB in the XZ plane is not particularly limited. The wording the "shape of the fixing depression 227UB" may refer to a three-dimensional shape of space that configures the fixing depression 227UB. For example, it may be preferable in particular that a depth of the fixing depression 227UB gradually increase in the insertion direction of the protrusion 302 and thereafter gradually decrease in the insertion direction of the protrusion 302. Specifically, it may be preferable that the separating member 227 include sloped surfaces that are so sloped that the depth of the fixing depression 227UB gradually increases in the insertion direction of the protrusion 302 and thereafter gradually decreases in the insertion direction of the protrusion 302. A three-dimensional shape of the fixing depression 227UB may be a triangular prism shape having an upper surface and a lower surface (a bottom surface) that each has an isosceles triangle shape or any other shape, for example. One reason for this is that it is easier for the projection 225P to be removed from the fixing depression 227UB on an as-needed basis upon the movement (the forward movement or the backward movement) of the insertion regulating member 225 located at the initial position. This allows the insertion regulating member 225 to move more easily and more stably. It is to be noted that each of the foregoing sloped surfaces may include only a flat surface, include only a curved surface, or include both the flat surface and the curved surface.

When the insertion regulating member 225 is located at the regulating position, the fixing depression 227UA may be used to fix the insertion regulating member 225 by utilizing insertion of the projection 225P into the fixing depression 227UA. The wording "fix" used in relation to the foregoing function of the fixing depression 227UA may refer to fully fixing the insertion regulating member 225, thereby substantially causing the insertion regulating member 225 to be difficult to move. This may be directed to preventing the insertion regulating member 225 from moving again after the insertion regulating member 225 has moved from the initial position to the regulating position.

A shape of the fixing depression 227UA in the XZ plane is not particularly limited. The wording the "shape of the fixing depression 227UA" may refer to a three-dimensional shape of space that configures the fixing depression 227UA. For example, it may be preferable in particular that a depth of the fixing depression 227UA gradually increase in the insertion direction of the protrusion 302. Specifically, it may be preferable that an inner wall surface, of the separating member 227, inside the fixing depression 227UA include sloped surfaces that are so sloped that the depth of the fixing depression 227UA gradually increases in the insertion direction of the protrusion 302. A three-dimensional shape of the fixing depression 227UA may be a triangular prism shape having an upper surface and a lower surface (a bottom surface) that each has a right-angled triangle shape or any other shape, for example. One reason for this is that it is more difficult for the projection 225P to be removed from the fixing depression 227UA when the projection 225P is inserted into the fixing depression 227UA in response to the movement of the insertion regulating member 225 to the regulating position. This may be due to the height of the projection 225P that gradually increases in the insertion direction of the protrusion 302 as described above, for example. It is to be noted that each of the foregoing sloped surfaces may include a flat surface, include a curved surface, or include both the flat surface and the curved surface.

The separating member 227 may have the two fixing depressions 227UC and 227UD on the insertion regulating member 226 side, for example. The fixing depressions 227UC and 227UD may be disposed in order from side on which the protrusion 302 is inserted into the insertion chamber 224, for example. The projection 226P may be insertable into the fixing depression 227UD when the insertion regulating member 226 is located at the initial position. Further, the projection 226P may be insertable into the fixing depression 227UC when the insertion regulating member 226 is located at the regulating position. The fixing depression 227UC may correspond to a "fourth depression" in one specific but non-limiting embodiment of the technology. The fixing depression 227UD may correspond to a "third depression" in one specific but non-limiting embodiment of the technology.

A function and a shape in the XZ plane of the fixing depression 227UC may be similar to the function and the shape of the fixing depression 227UA, for example. A function and a shape in the XZ plane of the fixing depression 227UD may be similar to the function and the shape of the fixing depression 227UB, for example. One reason for this is that it is more difficult for the projection 226P to be removed from the fixing depression 227UC when the projection 226P is inserted into the fixing depression 227UC in response to the movement of the insertion regulating member 226 to the regulating position. This may be due to the height of the projection 226P that gradually increases in the insertion direction of the protrusion 302 as described above, for example. Further, another reason is that it is easier for the projection 226P to be removed from the fixing depression 227UD on an as-needed basis upon the movement (the forward movement or the backward movement) of the insertion regulating member 226 located at the initial position.

The movement controlling member 228 may be supported by a supporting part 230, for example. The supporting part 230 may be fixed onto the separating member 227, for example. The movement controlling member 228 may control the movement of each of the insertion regulating members 225 and 226.

The movement controlling member 228 may have a first end that is in contact with the insertion regulating member 225 and a second end that is in contact with the insertion regulating member 226, for example. Further, the movement controlling member 228 may be rotatable around a rotation shaft 229 while maintaining a state in which the movement controlling member 228 is in contact with the insertion regulating member 225 at the first end and in contact with the insertion regulating member 226 at the second end. The rotation shaft 229 may be located between the insertion regulating members 225 and 226.

Accordingly, the movement controlling member 228 may so rotate around the rotation shaft 229 that the first end of the movement controlling member 228 moves backward and the second end of the movement controlling member 228 moves forward, thereby pressing the insertion regulating member 226 from the initial position to the regulating position. Such rotation of the movement controlling member 228 may be performed in response to the insertion regulating member 225 being pressed by the protrusion 302 that has been inserted into the insertion chamber 223 from the opening 221.

Further, the movement controlling member 228 may so rotate around the rotation shaft 229 that the second end of the movement controlling member 228 moves backward and the first end of the movement controlling member 228 moves forward, thereby pressing the insertion regulating member 225 from the initial position to the regulating position. Such rotation of the movement controlling member 228 may be performed in response to the insertion regulating member 226 being pressed by the protrusion 302 that has been inserted into the insertion chamber 224 from the opening 222.

It is to be noted that the positions of the two protrusion regions R1 and R2 provided in the engaging section 301 may correspond to the positions of the two openings 221 and 222 provided in the development processor 200, specifically, provided in the engaged section 220.

It is to be noted that the number of the engaged section 220 provided in the development processor 200 may be one, or two or more, as with the number of the engaging section 301 provided in the developer container 300. However, the number of the engaged section 220 and the number of the engaging section 301 may be preferably equal to each other. FIG. 14 illustrates an example case where the number of the engaged section 220 is two, and the two engaged sections 220 are disposed in the Z direction.

<2-2. Operation>

An operation of the development unit 100 according to the present example embodiment may be similar to the operation of the development unit 100 according to the first example embodiment except that the development unit 100 according to the present example embodiment may perform the attachment regulating operation by the following procedure.

FIGS. 15 to 17 each describe the procedure of the attachment of the developer container 300 to the development processor 200. FIGS. 15 to 17 illustrate cross-sectional configurations corresponding to FIGS. 11 to 14. The description is given below referring to the attachment regulating operation performed with the engaging section 301 in the first row and the engaged section 220 in the first row as an example.

In this example, the two protrusions 302 of the two engaging sections 301 are disposed in Combination 2 as described above. The protrusion 302 is therefore disposed in the protrusion region R1 in the engaging section 301 in the first row.

Further, the insertion regulating member 225 is located at the initial position in the engaged section 220. The projection 225P is therefore inserted into the fixing depression 227UB. Further, the insertion regulating member 226 is located at the initial position in the engaged section 220. The projection 226P is therefore inserted into the fixing depression 227UD.

Referring to FIG. 14, upon performing the attachment regulating operation, first, the development processor 200 and the developer container 300 may be so caused to face each other that the position of the engaged section 220 and the position of the engaging section 301 are aligned with each other. This is directed to the attachment of the developer container 300 to the development processor 200.

Thereafter, referring to FIG. 15, the developer container 300 may be pressed against the development processor 200. The protrusion 302 may be thereby inserted into the insertion chamber 223 from the opening 221 in the engaged section 220.

In this case, the protrusion 302 may be pressed deeply into the insertion chamber 223 while the protrusion 302 presses the insertion regulating member 225. Accordingly, the movement controlling member 228 may so rotate around the rotation shaft 229 that the first end of the movement controlling member 228 in contact with the insertion regulating member 225 moves backward and the second end of the movement controlling member 228 in contact with the insertion regulating member 226 moves forward. The insertion regulating member 225 may thereby move backward whereas the insertion regulating member 226 may thereby move forward. As a result, the insertion regulating member 226 may move from the initial position to the regulating position.

Upon the movement of the insertion regulating member 226 from the initial state to the regulating state, the separating member 227 may remain stationary whereas the insertion regulating member 226 moves. Therefore, the projection 226P that has been inserted into the fixing depression 227UD may be removed from the fixing depression 227UD and thereafter be inserted into the fixing depression 227UC.

In this case, the projection 226P may be inserted into the fixing depression 227UD when the insertion regulating member 226 is located at the initial position. However, the height of the projection 226P may gradually increase in the insertion direction of the protrusion 302, whereas the depth of the fixing depression 227UD gradually increases in the insertion direction of the protrusion 302 and thereafter gradually decreases in the insertion direction of the protrusion 302. It may be therefore easy for the projection 226P to be removed from the fixing depression 227UD. The insertion regulating member 226 may be thus fixed temporarily by the projection 226P in accordance with the insertion of the projection 226P into the fixing depression 227UD.

In this state, when the insertion regulating member 226 moves forward, the force of the movement controlling member 228 pressing the insertion regulating member 226 may be greater than the force of the projection 226P temporarily fixing the insertion regulating member 226. Accordingly, the projection 226P may be removed from the fixing depression 227UD, thereby causing the insertion regulating member 226 to move from the initial position toward the regulating position.

When the insertion regulating member 226 moves to the regulating position, the projection 226P that has been removed from the fixing depression 227UD may be inserted into the fixing depression 227UC. The height of the fixing depression 227UC may gradually increase in the insertion direction of the protrusion 302. The projection 226P may be therefore difficult to be removed from the fixing depression 227US in this case. The insertion regulating member 226 may be thus fully fixed by the projection 226P.

As a result, the insertion regulating member 226 may move to a position in the vicinity of the opening 222, i.e., to the regulating position, thereby substantially blocking the opening 222.

It is to be noted that the projection 225P may be removed from the fixing depression 227UB when the insertion regulating member 225 moves backward. In this case, the projection 225P and the part around the projection 225P may be away from the separating member 227 by utilizing the deformation of the projection 225P and the part around the projection 225P by means of the deformation depression 227UC. Accordingly, the insertion regulating member 225 may so move backward as to be away from the opening 221 while maintaining the state in which the projection 225P and the part around the projection 225P are away from the separating member 227.

Lastly, referring to FIG. 16, when the protrusion 302 that has been inserted into the insertion chamber 223 is removed from the insertion chamber 223, the insertion regulating member 226 may be fully fixed by the projection 226P as described above. Therefore, a state in which the insertion regulating member 226 is located at the regulating position may be maintained even after the developer container 300 is detached from the development processor 200.

The attachment regulating operation may be thus completed. After the completion of the attachment regulating operation, the insertion of the protrusion 302 into the insertion chamber 223 from the opening 221 may be permitted in the engaged section 220, whereas the insertion of the protrusion 302 into the insertion chamber 224 from the opening 222 may be prohibited in the engaged section 220.

Specifically, referring to FIG. 17, the protrusion 302 may be disposed in the protrusion region R2 in the engaging section 301 in the first row in the developer container 300. When an attempt is made to attach the developer container 300 in the foregoing state to the development processor 200, the protrusion 302 is not insertable into the insertion chamber 224 from the opening 222.

The attachment regulating operation described above may be similarly performed for the engaging section 301 in the second row and the engaged section 220 in the second row.

Specifically, the protrusion 302 may be disposed in the protrusion region R2 in the engaging section 301 in the second row, for example. The protrusion 302 thus disposed may be inserted into the insertion chamber 224 from the opening 222. Accordingly, after the developer container 300 is detached from the development processor 200, the insertion of the protrusion 302 into the insertion chamber 224 from the opening 222 may be permitted in the engaged section 220 in the second row, whereas the insertion of the protrusion 302 into the insertion chamber 223 from the opening 221 may be prohibited in the engaged section 220 in the second row.

Accordingly, when an attempt is made to attach, to the development processor 200, another developer container 300 that has an arrangement combination of the two protrusions 302 different from that of the developer container 300 used in performing the foregoing attachment regulating operation, such a developer container 300 having the different arrangement combination of the two protrusions 302 may not be attachable to the development processor 200. This prevents an inappropriate developer container 300 from being mistakenly attached to the development processor 200.

<2-3. Workings and Effects>

The development unit 100 according to the present example embodiment may include the development processor 200 having the engaged section 220 and the developer container 300 having the engaging section 301. The development processor 200 may correspond to the "attached unit" in one specific but non-limiting embodiment of the technology. The developer container 300 may correspond to the "attachable unit" in one specific but non-limiting embodiment of the technology. Upon the attachment of the developer container 300 to the development processor 200, when the engaging section 301 is brought into engagement with the engaged section 220 attachably and detachably, the state of the engaged section 220 changes in response to the engagement of the engaging section 301. The state of the engaged section 220 upon the engagement of the engaging section 301, i.e., the state of the engaged section 220 after the change is maintained even after the engaging section 301 is detached from the engaged section 220. In this case, an inappropriate developer container 300 is prevented from being attached to the development processor 200 after one of the insertion regulating members 225 and 226 has moved to the regulating position as described above. It is therefore possible to prevent the developer container 300 from being mistakenly attached to the development processor 200.

In particular, it is possible to sufficiently prevent an inappropriate developer container 300 from being attached to the development processor 200 under the conditions that: the engaged section 220 includes the insertion regulating members 225 and 226; and one of the insertion regulating members 225 and 226 is movable from the initial position to the regulating position. In this case, it is easier for one of the insertion regulating members 225 and 226 to move from the initial position to the regulating position when the movement controlling member 228 having the following configuration is provided. That is, the movement controlling member 228 utilizes the rotation operation of the movement controlling member 228 and thereby presses the one of the insertion regulating members 225 and 226 from the initial position to the regulating position, in response to the other of the insertion regulating members 225 and 226 being pressed by the protrusion 302. Accordingly, it is possible to achieve a higher effect.

Moreover, unintentional movement of each of the insertion regulating members 225 and 226 is suppressed when the separating member 227 has the two fixing depressions 227UA and 227UB into which the projection 225P is to be inserted and also has the two fixing depressions 227UC and 227UD into which the projection 226P is to be inserted. It is therefore possible to achieve a higher effect.

In this case, the insertion regulating members 225 and 226 are temporarily fixed at the initial position by the projections 225P and 226P, respectively under the conditions that: the height of each of the projections 225P and 226P gradually increases in the insertion direction of the protrusion 302; and that the depth of each of the fixing depressions 227UB and 227UD gradually increases in the insertion direction of the protrusion 302 and thereafter gradually decreases in the insertion direction of the protrusion 302. Accordingly, the projections 225P and 226P are easily removed from the fixing depressions 227UB and 227UD, respectively, on an as-needed basis. It is therefore possible to achieve a higher effect.

Further, the insertion regulating members 225 and 226 are fully fixed by the projections 225P and 226P, respectively, when the depths of the respective fixing depressions 227UA and 227UC gradually increase in the insertion direction of the protrusion 302. Accordingly, the projections 225P and 226P are more difficult to be removed from the fixing depressions 227UA and 227UC, respectively. It is therefore possible to achieve a higher effect.

It is easier for the insertion regulating member 225 to be fixed by the projection 225P and it is also easier for the insertion regulating member 226 to be fixed by the projection 226P when the projections 225P and 226P are each biased toward the separating member 227. It is therefore possible to achieve a higher effect.

Workings and effects other than those described above may be similar to those of the development unit 100 according to the foregoing first example embodiment.

<3. Image Forming Apparatus>

An image forming apparatus using the development unit according to any of the foregoing example embodiments of the technology is described below.

The image forming apparatus described below may be a full-color printer using an electrophotographic method, for example. The image forming apparatus may form an image on a surface of a medium M, for example. A material of the medium M is not particularly limited. However, the material of the medium M may be one or more of materials such as paper and a film <3-1. Configuration>

Figure 18:
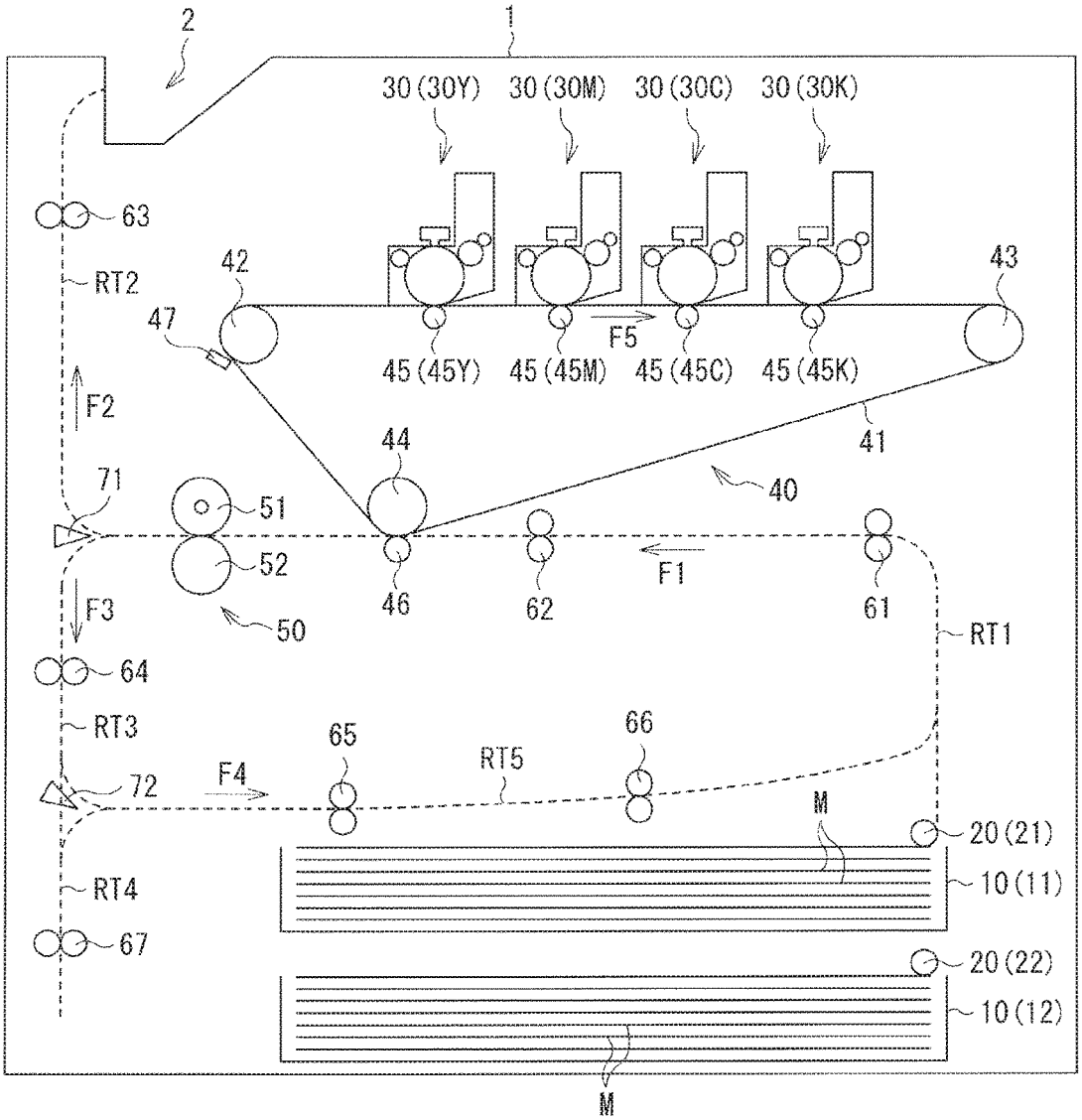
FIG. 18 schematically illustrates a configuration example of an image forming apparatus according to one example embodiment of the technology.

An overall configuration of the image forming apparatus is described. FIG. 18 schematically illustrates an example of the configuration of the image forming apparatus.

Referring to FIG. 18, the image forming apparatus may include, inside a housing 1, one or more trays 10, one or more feeding rollers 20, one or more developing unit 30, a transferring unit 40, a fixing unit 50, conveying rollers 61 to 67, and conveying path switching guides 71 and 72, for example.

The housing 1 may include a stacker 2 into which the medium M on which an image is formed is to be discharged. The medium M may be conveyed along conveying routes RT1 to RT5.

[Tray and Feeding Roller]

The one or more trays 10 each may contain the medium M. The one or more trays 10 may each be attached to the housing 1 detachably, for example. One or more trays 10 may each contain a plurality of media M in a stacked state, for example. The media M may be picked out one by one from the corresponding tray 10 by the corresponding feeding roller 20.

In this example, the image forming apparatus may include two trays 10, i.e., trays 11 and 12, and include two feeding rollers 20, i.e., feeding rollers 21 and 22, for example. The two trays 11 and 12 may overlap with each other, for example.

[Developing Unit]

The one or more developing units 30 each may perform a development process with a developer. The one or more developing units 30 each may have a configuration similar to that of the development unit according to any one of the foregoing example embodiments of the technology. Specifically, the one or more developing units 30 each may have a configuration similar to that of the development unit 100 according to the foregoing first example embodiment, or may have a configuration similar to that of the development unit 100 according to the foregoing second example embodiment.

In this example, the image forming apparatus may include four developing units 30, i.e., the developing units 30Y, 30M, 30C, and 30K, for example.

The developing units 30Y, 30M, 30C, and 30K each may be attached detachably to the housing 1, and may be disposed along a traveling path of an intermediate transfer belt 41 which will be described later, for example. In this example, the developing units 30Y, 30M, 30C, and 30K may be disposed in order from the upstream toward the downstream in the traveling direction of the intermediate transfer belt 41, for example.

The developing units 30Y, 30M, 30C, and 30K may have similar configurations except for having developers different in type from each other, for example. The developing unit 30Y may contain a yellow developer, for example. The developing unit 30M may contain a magenta developer, for example. The developing unit 30C may contain a cyan developer, for example. The developing unit 30K may contain a black developer, for example.

[Transferring Unit]

The transferring unit 40 may perform a transfer process with the developers that have been subjected to the development process by each of the developing units 30. Specifically, the transferring unit 40 may transfer, onto the medium M, the developer attached to an electrostatic latent image by each of the developing units 30.

The transferring unit 40 may include the intermediate transfer belt 41, a driving roller 42, a driven roller (an idle roller) 43, a backup roller 44, one or more primary transfer rollers 45, a secondary transfer roller 46, and a cleaning blade 47, for example.

The intermediate transfer belt 41 may be an intermediate transfer medium onto which the developer is temporarily transferred before the developer is transferred onto the medium M. The intermediate transfer belt 41 may be an endless elastic belt, for example. The intermediate transfer belt 41 may include one or more of polymer compounds such as polyimide. The intermediate transfer belt 41 may be movable in response to rotation of the driving roller 42 while lying on the driving roller 42, the driven roller 43, and the backup roller 44.

The driving roller 42 may be rotatable clockwise with a drive source such as a motor. Each of the driven roller 43 and the backup roller 44 may be rotatable clockwise as with the driving roller 42 in response to the rotation of the driving roller 42.

The one or more primary transfer rollers 45 each may transfer the developer fed from the developing unit 30 onto the intermediate transfer belt 41. In other words, the one or more primary transfer rollers 45 each may perform primary transfer. The one or more primary transfer rollers 45 each may be so pressed against the developing unit 30 as to be in contact with the corresponding developing unit 30, specifically, a photosensitive drum in the corresponding developing unit 30, with the intermediate transfer belt 41 in between. The one or more primary transfer roller 45 each may be rotatable clockwise in accordance with the traveling of the intermediate transfer belt 41.

In this example, the transferring unit 40 may include four primary transfer rollers 45, i.e., primary transfer rollers 45Y, 45M, 45C, and 45K corresponding to the four developing units 30, i.e., the developing units 30Y, 30M, 30C, and 30K, for example. The transferring unit 40 may also include one secondary transfer roller 46 corresponding to the one backup roller 44.

The secondary transfer roller 46 may transfer, onto the medium M, the developer that has been transferred onto the intermediate transfer belt 41. In other words, the secondary transfer roller 46 may perform secondary transfer. The secondary transfer roller 46 may be so pressed against the backup roller 44 as to be in contact with the backup roller 44. The secondary transfer roller 46 may include a core member and an elastic layer, for example. The core member may be made of metal or any other material, for example. The elastic layer may include a foamed rubber layer that covers an outer peripheral surface of the core member, for example. The secondary transfer roller 46 may be rotatable anticlockwise in accordance with the traveling of the intermediate transfer belt 41.

The cleaning blade 47 may be so pressed against the intermediate transfer belt as to be in contact with the intermediate transfer belt 41. The cleaning blade 47 may scrape off unnecessary remains of the developer on the surface of the intermediate transfer belt 41.

[Fixing Unit]

The fixing unit 50 may perform a fixing process using the developer that has been transferred onto the medium M by the transferring unit 40. Specifically, the fixing unit 50 may apply pressure on the developer that has been transferred onto the medium M by the transferring unit 40 while applying heat to the developer. The fixing unit 50 may thus fix the developer onto the medium M.

The fixing unit 50 may include a heating roller 51 and a pressurizing roller 52, for example.

The heating roller 51 may be a rotating body that applies heat to the developer image. The heating roller 51 may be rotatable clockwise. The heating roller 51 may include a metal core and a resin coating, for example. The metal core may have a hollow cylindrical shape, for example. The resin coating may be provided on the surface of the metal core. The metal core may include a metal material such as aluminum, for example. The resin coating may include a polymer compound such as a copolymer of tetrafluoroethylene and perfluoroalkylvinylether (PFA) and polytetrafluoroethylene (PTFE), for example.

A heater may be provided inside the metal core of the heating roller 51, for example. Non-limiting examples of the heater may include a halogen lamp. The surface temperature of the heating roller 51 may be detected by a thermistor that is provided at a position away from the heating roller 51, for example.

The pressurizing roller 52 may be a rotating body that applies pressure onto the developer image. The pressurizing roller 52 may be rotatable anticlockwise while being so pressed against the heating roller 51 as to be in contact with the heating roller 51. The pressurizing roller 52 may be a metal rod, for example. The metal bar may include a metal material such as aluminum, for example.

[Conveying Rollers]

Each of the conveying rollers 61 to 67 may include a pair of rollers that face each other with corresponding one of the conveying routes RT1 to RT5 of the medium M in between. Each of the conveying rollers 61 to 67 may convey the medium M that has been taken out by the feeding rollers 20. Specifically, in an example case where an image is formed only on one surface of the medium M, the medium M may be conveyed by the conveying rollers 61 to 63 along the conveying routes RT1 and RT2. In another example case where images are formed on both surfaces of the medium M, the medium M may be conveyed by the conveying rollers 61 to 67 along the conveying routes RT1 to RT5.

[Conveying Path Switching Guide]

The conveying path switching guides 71 and 72 each may switch the conveying direction of the medium M depending on conditions such as a manner in which an image is formed on the medium M. The conditions on the manner in which an image is formed on the medium M may include whether an image is formed on only one surface of the medium M and whether images are formed on both surfaces of the medium M, for example.

<3-2. Operation>

An operation of the image forming apparatus is described below.

An example case where an image is formed on only one surface of the medium M is described below referring to FIG. 18. In this case, the medium M that is contained in the tray 11 may be used.

The image forming apparatus may perform processes such as a developing process, a transferring process, a fixing process, and a cleaning process as described below, for example.

[Developing Process]

The medium M contained in the tray 11 may be taken out by the feeding roller 21. The medium M may be conveyed by the conveying rollers 61 and 62 in a direction indicated by an arrow F1 along the conveying route RT1.

Upon the developing process, the developing unit 30Y may operate by a procedure similar to that of the development unit according to any of the example embodiments of the technology described above. The yellow developer may be thereby attached onto the surface of the photosensitive drum, i.e., onto the electrostatic latent image. The yellow developer image may be thus formed.

[Primary Transfer Process]

In the transferring unit 40, when the driving roller 42 rotates, the driven roller 43 and the backup roller 44 may be rotated in accordance with the rotation of the driving roller 42. The intermediate transfer belt 41 may thereby travel in a direction indicated by an arrow F5.

The primary transfer process may involve application of a voltage to the primary transfer roller 45Y. The primary transfer roller 45Y may be so pressed against the photosensitive drum as to be in contact with the photosensitive drum with the intermediate transfer belt 41 in between. Accordingly, the yellow developer that has been attached onto the surface of the photosensitive drum, i.e., onto the electrostatic latent image in the foregoing developing process may be transferred onto the intermediate transfer belt 41.

Thereafter, the intermediate transfer belt 41 onto which the yellow developer is transferred may continue to travel in the direction indicated by the arrow F5. Accordingly, the developing process and the primary transfer process may be sequentially performed by the developing units 30M, 30C, and 30K, and the primary transfer rollers 45M, 45C, and 45K. The procedure of the developing process and the primary transfer process performed by the developing units 30M, 30C, and 30K, and the primary transfer rollers 45M, 45C, and 45K may be similar to that performed by the developing unit 30Y and the primary transfer roller 45Y described above. The developers of the respective colors may be sequentially transferred onto the intermediate transfer belt 41 in such a manner. The developer images of the respective colors may be thus formed on the intermediate transfer belt 41.

Specifically, the developing unit 30M and the primary transfer roller 45M may transfer the magenta developer onto the surface of the intermediate transfer belt 41, thereby forming the magenta developer image. Thereafter, the developing unit 30C and the primary transfer roller 45C may transfer the cyan developer onto the surface of the intermediate transfer belt 41, thereby forming the cyan developer image. Thereafter, the developing unit 30K and the primary transfer roller 45K may transfer the black developer onto the surface of the intermediate transfer belt 41, thereby forming the black developer image.

It is to be noted that whether each of the developing units 30Y, 30M, 30C, and 30K actually performs the developing process and whether corresponding one of the primary transfer rollers 45Y, 45M, 45C, and 45K actually performs the transferring process are determined depending on colors necessary to form an image, specifically, on types of the developers and combination thereof.

[Secondary Transfer Process]

The medium M that is conveyed along the conveying route RT1 may pass between the backup roller 44 and the secondary transfer roller 46.

The secondary transfer process may involve application of a voltage to the secondary transfer roller 46. The secondary transfer roller 46 may be so pressed against the backup roller 44 as to be in contact with the backup roller 44 with the medium M in between. Accordingly, the developer that has been transferred onto the intermediate transfer belt 41 in the foregoing primary transfer process may be transferred onto the medium M.

[Fixing Process]

After the developer has been transferred onto the medium M in the secondary transfer process, the medium M may continue to be conveyed in the direction indicated by the arrow F1 along the conveying route RT1. The medium M may be thus brought into the fixing unit 50.

Upon the fixing process, the surface temperature of the heating roller 51 may be so controlled as to be at a predetermined temperature. In response to the rotation of the pressurizing roller 52 that is so pressed against the heating roller 51 as to be in contact with the heating roller 51, the medium M may be so conveyed as to pass between the heating roller 51 and the pressurizing roller 52.

The developer that has been transferred onto the surface of the medium M may be thereby heated. This may melt the developer. The developer in a melted state may be so pressed against the medium M as to be in contact with the medium M, thereby being firmly attached onto the medium M. As a result, an image may be formed on the surface of the medium M.

The medium M onto which the image has been formed may be conveyed by the conveying roller 63 in a direction indicated by an arrow F2 along the conveying route RT2. The medium M may be thus discharged into the stacker 2.

The procedure of conveying the medium M may vary depending on a manner in which an image is formed on the surface of the medium M, which is not described in detail in this description.

In an example case where images are to be formed on both surfaces of the medium M, the medium M that has passed through the fixing unit 50 may be conveyed by the conveying rollers 64 to 67 in directions indicated by arrows F3 and F4 along the conveying routes RT3 to RT5. Thereafter, the medium M may be conveyed again by the conveying rollers 61 and 62 in the direction indicated by the arrow F1 along the conveying route RT1. Upon conveying of the medium M, the direction in which the medium M is to be conveyed may be controlled by the conveying path switching guides 71 and 72. Thus, the developing process, the primary transfer process, the secondary transfer process, and the fixing process may be also performed on a back surface of the medium M, i.e., on a surface on which an image has not been formed yet.

In another example case where images are formed on one surface of the medium M a plurality of times, the medium M that has passed through the fixing unit 50 may be conveyed by the conveying rollers 64 to 66 in the directions indicated by the arrows F3 and F4 along the conveying routes RT3 and RT5. Thereafter, the medium M may be conveyed again by the conveying rollers 61 and 62 in the direction indicated by the arrow F1 along the conveying route RT1. Upon conveying the medium M that has passed through the fixing unit 50, the direction in which the medium M is to be conveyed may be controlled by the conveying path switching guides 71 and 72. Thus, the developing process, the primary transfer process, the secondary transfer process, and the fixing process may be performed again on the surface of the medium M, i.e., on the surface on which an image has been formed already.

[Cleaning Process]

The image forming apparatus may perform the cleaning process at any timing.

Unnecessary remains of the developer may be present on the surface of the photosensitive drum in the developing unit 30Y. The unnecessary remains of the developer may be part of the developer that has been used in the primary transfer process, which may be the developer that has remained on the surface of the photosensitive drum without being transferred onto the intermediate transfer belt 41, for example.

To address this, the photosensitive drum may rotate while being so pressed against the cleaning blade as to be in contact with the cleaning blade in the developing unit 30Y. This may cause the remains of the developer present on the surface of the photosensitive drum to be scraped off by the cleaning blade. As a result, the unnecessary remains of the developer may be removed from the surface of the photosensitive drum.

The foregoing cleaning process using the cleaning blade may be performed similarly in each of the developing units 30M, 30C, and 30K.

In the transferring unit 40, part of the developer that has been transferred onto the surface of the intermediate transfer belt 41 in the primary transfer process may not be transferred onto the surface of the medium M in the secondary transfer process and may remain on the surface of the intermediate transfer belt 41.

To address this, the cleaning blade 47 may scrape off the remains of the developer present on the surface of the intermediate transfer belt 41 in the transferring unit 40 upon traveling of the intermediate transfer belt 41 in the direction indicated by the arrow F5. As a result, unnecessary remains of the developer may be removed from the surface of the intermediate transfer belt 41.

<3-3. Workings and Effects>

The developing unit 30 of the foregoing image forming apparatus may have a configuration similar to the development unit according to any of the example embodiments of the technology described above. The developing unit 30 is therefore prevented from being mistakenly attached. This example uses four developing units 30 containing developers of colors different from each other, i.e., the developing units 30Y, 30M, 30C, and 30K, in particular. It is therefore possible to prevent the foregoing four developing units 30 from being mistakenly attached.

Workings and effects other than those described above may be similar to those of the development unit according to any of the example embodiments of the technology described above.

<4. Modifications>

The foregoing configuration of the development unit 100 including the development processor 200 and the developer container 300 is modifiable as appropriate.

[Modification 1]

Figure 19:
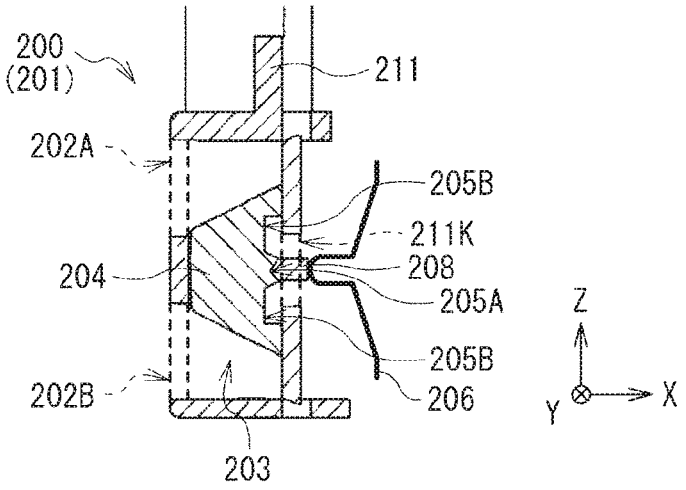
FIG. 19 is a cross-sectional diagram describing a modification of the configuration of the development unit.

Referring to FIG. 19 corresponding to FIG. 6, in one example modification of the first example embodiment, the engaged section 201 may include a fixing member 208 instead of the foregoing fixing member 206 and may utilize the fixing member 206 as a biasing member that presses the fixing member 208 against the insertion regulating member 204. In this example case, the fixing member 208 has a function of fixing the insertion regulating member 204, and the fixing member 206 has a function of pressing the fixing member 208 against the insertion regulating member 204. It is possible to achieve similar effects also in this example case.

[Modification 2]

In the first example embodiment, the development processor 200 includes the engaged section 201 and the developer container 300 includes the engaging section 301, for example. However, in another example modification of the first example embodiment, the development processor 200 may include the engaging section 301 and the developer container 300 may include the engaged section 201. Similarly, in the second example embodiment, the development processor 200 includes the engaged section 220 and the developer container 300 includes the engaging section 301, for example. However, in one example modification of the second example embodiment, the development processor 200 may include the engaging section 301 and the developer container 300 may include the engaged section 220. It is possible to achieve similar effects also in these example cases.

[Modification 3]

Moreover, in each of the first and second example embodiments, the developer container 300 in the development unit 100 serves as the "attachable unit" in one specific but non-limiting embodiment of the technology and the development processor 200 in the development unit 100 serves as the "attached unit" in one specific but non-limiting embodiment of the technology. However, any configuration unit other than the developer container 300 may serve as the "attachable unit", or any configuration unit other than the development processor 200 may serve as the "attached unit" under the condition that the foregoing two configuration units other than the developer container 300 and the development processor 200 are any two configuration units that configure the development unit 100 and are necessary to be combined with each other upon the use of the development unit 100. The attachable unit is attached to the attached unit by means of the engaging section and the engaged section also in this case. Accordingly, it is possible to achieve similar effects.

Although some preferred example embodiments of the technology have been described in the foregoing by way of example with reference to the accompanying drawings, the technology is by no means limited to the example embodiments described above. It should be appreciated that modifications and alterations may be made by persons skilled in the art without departing from the scope as defined by the appended claims. The technology is intended to include such modifications and alterations in so far as they fall within the scope of the appended claims or the equivalents thereof. For example, the image forming method of the image forming apparatus according to one example embodiment of the technology is not limited to the intermediate transfer method using the intermediate transfer belt, and may be any other image forming method.

It is possible to achieve at least the following configurations from the above-described example embodiments of the invention.

(1)

A development unit including:

an attachable unit including an engaging section; and an attached unit including an engaged section that allows the engaging section to be brought into engagement with the engaged section attachably and detachably, and whose state changes in response to the engagement of the engaging section, the state of the engaged section upon the engagement of the engaging section being maintained even after the engaging section is detached from the engaged section.

(2)

The development unit according to (1), wherein the attachable unit is a developer container that contains a developer, and the attached unit is a development processor that attaches, onto an electrostatic latent image, the developer fed from the developer container.

(3)

The development unit according to (1) or (2), wherein the engaging section includes a protrusion that is disposed in one of a first protrusion region and a second protrusion region, and the engaged section includes:

an insertion chamber that has a first opening and a second opening, and into which the protrusion is insertable from either of the first opening and the second opening; and an insertion regulating member that is disposed inside the insertion chamber, and is movable from an initial position to a regulating position in a direction intersecting a direction in which the protrusion is to be inserted into the insertion chamber, the insertion regulating member allowing, upon being located at the initial position, the protrusion to be inserted into the insertion chamber from either of the first opening and the second opening, the insertion regulating member preventing, upon being located at the regulating position, the protrusion from being inserted into the insertion chamber from one of the first opening and the second opening in response to the insertion of the protrusion into the insertion chamber from the other of the first opening and the second opening.

(4)

The development unit according to (3), wherein the insertion regulating member includes a pair of sloped surfaces that are located at positions corresponding to the respective first and second openings when the insertion regulating member is located at the initial position, the pair of sloped surfaces being able to be brought into contact with the protrusion and each being sloped with respect to the direction in which the protrusion is to be inserted into the insertion chamber.

(5)

The development unit according to (3) or (4), wherein the engaged section further includes a fixing member that fixes the insertion regulating member.

(6)

The development unit according to (5), wherein the insertion regulating member has a first fixing depression and a pair of second fixing depressions on side opposite to side on which the protrusion is to be inserted into the insertion chamber, the pair of second fixing depressions being provided on respective sides of the first fixing depression in a direction in which the insertion regulating member moves, the pair of second fixing depressions each having a depth that is greater than a depth of the first fixing depression, and the fixing member is inserted into the first fixing depression when the insertion regulating member is located at the initial position, and becomes insertable into one of the pair of second fixing depressions in response to the movement of the insertion regulating member from the initial position to the regulating position.

(7)

The development unit according to (6), wherein the depth of the first fixing depression gradually increases in a direction of being closer to the first fixing depression from one of the pair of second fixing depressions, and gradually increases in a direction of being closer to the first fixing depression from the other of the pair of second fixing depressions.

(8)

The development unit according to any one of (5) to (7), wherein the fixing member is biased toward the insertion regulating member.

(9)

The development unit according to (8), wherein the engaged section further includes a biasing member that biases the fixing member toward the insertion regulating member.

(10)

The development unit according to (1) or (2), wherein the engaging section includes a protrusion that is disposed in one of a first protrusion region and a second protrusion region, and the engaged section includes a first insertion chamber that has a first opening, and into which the protrusion is insertable from the first opening, a second insertion chamber that has a second opening, and into which the protrusion is insertable from the second opening, a first insertion regulating member that is disposed inside the first insertion chamber, and is movable in a direction in which the protrusion is to be inserted into the first insertion chamber, a second insertion regulating member that is disposed inside the second insertion chamber, and is movable in a direction in which the protrusion is to be inserted into the second insertion chamber, and a movement controlling member that causes the first insertion regulating member to move from an initial position to a regulating position, in response to the second insertion regulating member being pressed by the protrusion that has been inserted into the second insertion chamber from the second opening, the first insertion regulating member allowing, upon being located at the initial position, the protrusion to be inserted into either of the first insertion chamber and the second insertion chamber from corresponding one of the first opening and the second opening, the first insertion regulating member preventing, upon being located at the regulating position, the protrusion from being inserted into the first insertion chamber from the first opening, or causes the second insertion regulating member to move from an initial position to a regulating position, in response to the first insertion regulating member being pressed by the protrusion that has been inserted into the first insertion chamber from the first opening, the second insertion regulating member allowing, upon being located at the initial position, the protrusion to be inserted into either of the first insertion chamber and the second insertion chamber from corresponding one of the first opening and the second opening, the second insertion regulating member preventing, upon being located at the regulating position, the protrusion from being inserted into the second insertion chamber from the second opening.

(11)

The development unit according to (10), wherein the movement controlling member is able to rotate around a rotation shaft and thereby press one of the first insertion regulating member and the second insertion regulating member from the initial position to the regulating position in response to the other of the first insertion regulating member and the second insertion regulating member being pressed by the protrusion, the rotation shaft being located between the first insertion regulating member and the second insertion regulating member.

(12)

The development unit according to (10) or (11), wherein the engaged section further includes a separating member that is disposed between the first insertion chamber and the second insertion chamber, the first insertion regulating member includes a first projection that projects in a direction of being closer to the separating member, the second insertion regulating member includes a second projection that projects in the direction of being closer to the separating member, and the separating member has a first fixing depression into which the first projection is insertable when the first insertion regulating member is located at the initial position, a second fixing depression into which the first projection is insertable when the first insertion regulating member is located at the regulating position, a third fixing depression into which the second projection is insertable when the second insertion regulating member is located at the initial position, and a fourth fixing depression into which the second projection is insertable when the second insertion regulating member is located at the regulating position.

(13)

The development unit according to (12), wherein each of the first projection and the second projection has a height that gradually increases in the direction in which the protrusion is to be inserted, each of the first fixing depression and the third fixing depression has a depth that gradually increases and thereafter gradually decreases in the direction in which the protrusion is to be inserted, and each of the second fixing depression and the fourth fixing depression has a depth that gradually increases in the direction in which the protrusion is to be inserted.

(14)

The development unit according to (12) or (13), wherein the first projection is biased toward the separating member, and the second projection is biased toward the separating member.

(15)

The development unit according to any one of (1) to (14), wherein the engaging section has a protrusion depression and a protrusion member, the protrusion depression being provided in a region covering from a first protrusion region to a second protrusion region, the protrusion member being inserted into the protrusion depression and thereby partially protruding in one of the first protrusion region and the second protrusion region and not protruding in a region other than the one of the first protrusion region and the second protrusion region in which the protrusion member protrudes.

(16)

The development unit according to (15), wherein the engaging section includes an alignment projection inside the protrusion depression, and the protrusion member has one of an alignment depression and an alignment opening into which the alignment projection is insertable.

(17)

The development unit according to any one of (1) to (16), wherein the engaging section included in the attachable unit includes two or more engaging sections, and the engaged section included in the attached unit includes two or more engaged sections.

(18)

A development processing unit including an engaged section that allows an engaging section of an attachable unit to be brought into engagement with the engaged section attachably and detachably, and whose state changes in response to the engagement of the engaging section, the state of the engaged section upon the engagement of the engaging section being maintained even after the engaging section is detached from the engaged section.

(19)

The development processing unit according to (18), wherein the attachable unit is a developer containing unit that contains a developer, and the development processing unit attaches, onto an electrostatic latent image, the developer fed from the developer containing unit.

(20)

The development processing unit according to (18) or (19), wherein the engaged section includes two or more engaged sections.

(21)

A developer containing unit including an engaging section that is to be brought into engagement with an engaged section of an attached unit attachably and detachably, the engaging section including a protrusion that is provided in one of a first protrusion region and a second protrusion region.

(22)

The developer containing unit according to (21), wherein the attached unit is a development processing unit that attaches a developer onto an electrostatic latent image, and the developer containing unit feeds the developer to the development processing unit.

(23)

The developer containing unit according to (21) or (22), wherein the engaging section includes two or more engaging sections.

(24)

An image forming apparatus including:

an attachable unit having an engaging section; and an attached unit having an engaged section that allows the engaging section to be brought into engagement with the engaged section attachably and detachably, and whose state changes in response to the engagement of the engaging section, the state of the engaged section upon the engagement of the engaging section being maintained even after the engaging section is detached from the engaged section.

(25)

The image forming apparatus according to claim 24, further including:

a developing unit including a developer container and a development processor, the developer container containing a developer, the development processor attaching, onto an electrostatic latent image, the developer fed from the developer container;

a transferring unit that transfers, onto a medium, the developer attached onto the electrostatic latent image; and a fixing unit that fixes the developer transferred onto the medium, wherein the attachable unit is the developer container, and the attached unit is the development processor.

According to the developer containing unit, the development processing unit, the development unit, and the image forming apparatus each according to one embodiment of the technology, each of the attachable unit having the engaging section and the attached unit having the engaged section has the foregoing configuration. It is therefore possible to prevent attachment from being performed mistakenly.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A development unit comprising:

an attachable unit including an engaging section, the attachable unit being a developer container that contains a developer; and an attached unit including an engaged section that allows the engaging section to be brought into engagement with the engaged section attachably and detachably, and whose state changes in response to the engagement of the engaging section, the state of the engaged section upon the engagement of the engaging section being maintained even after the engaging section is detached from the engaged section, the attached unit being a development processor that attaches, onto an electrostatic latent image, the developer fed from the developer container, wherein the engaged section includes a first engagement part and a second engagement part, the engaging section is engageable with any of the first engagement part and the second engagement part, and the engaging section is prevented from being in engagement with one of the first engagement part and the second engagement part when the engaging section is in engagement with the other of the first engagement part and the second engagement part.

2. The development unit according to claim 1, wherein the first engagement part is a first opening, and the second engagement part is a second opening, and the engaging section includes a protrusion that is disposed in one of a first protrusion region and a second protrusion region, and the engaged section includes:

an insertion chamber that has the first opening and the second opening, and into which the protrusion is insertable from either of the first opening and the second opening; and an insertion regulating member that is disposed inside the insertion chamber, and is movable from an initial position to a regulating position in a direction intersecting a direction in which the protrusion is to be inserted into the insertion chamber, the insertion regulating member allowing, upon being located at the initial position, the protrusion to be inserted into the insertion chamber from either of the first opening and the second opening, the insertion regulating member preventing, upon being located at the regulating position, the protrusion from being inserted into the insertion chamber from one of the first opening and the second opening in response to the insertion of the protrusion into the insertion chamber from the other of the first opening and the second opening.

3. The development unit according to claim 2, wherein the insertion regulating member includes a pair of sloped surfaces that are located at positions corresponding to the respective first and second openings when the insertion regulating member is located at the initial position, the pair of sloped surfaces being able to be brought into contact with the protrusion and each being sloped with respect to the direction in which the protrusion is to be inserted into the insertion chamber.

4. The development unit according to claim 2, wherein the engaged section further includes a fixing member that fixes the insertion regulating member.

5. The development unit according to claim 4, wherein the insertion regulating member has a first fixing depression and a pair of second fixing depressions on a side opposite to a side on which the protrusion is to be inserted into the insertion chamber, the pair of second fixing depressions being provided on respective sides of the first fixing depression in a direction in which the insertion regulating member moves, the pair of second fixing depressions each having a depth that is greater than a depth of the first fixing depression, and the fixing member is inserted into the first fixing depression when the insertion regulating member is located at the initial position, and becomes insertable into one of the pair of second fixing depressions in response to the movement of the insertion regulating member from the initial position to the regulating position.

6. The development unit according to claim 4, wherein the fixing member is biased toward the insertion regulating member.

7. The development unit according to claim 1, wherein the engaging section has a protrusion depression and a protrusion member, the protrusion depression being provided in a region covering from a first protrusion region to a second protrusion region, the protrusion member being inserted into the protrusion depression and thereby partially protruding in one of the first protrusion region and the second protrusion region and not protruding in a region other than the one of the first protrusion region and the second protrusion region in which the protrusion member protrudes, the engaging section includes an alignment projection inside the protrusion depression, and the protrusion member has one of an alignment depression and an alignment opening into which the alignment projection is insertable.

8. The development unit according to claim 1, wherein the engaging section included in the attachable unit comprises two or more engaging sections, and the engaged section included in the attached unit comprises two or more engaged sections.

9. A development processing unit comprising:

an engaged section that allows an engaging section of an attachable unit to be brought into engagement with the engaged section attachably and detachably, and whose state changes in response to the engagement of the engaging section, the state of the engaged section upon the engagement of the engaging section being maintained even after the engaging section is detached from the engaged section, the attachable unit being a developer containing unit that contains a developer, and the development processing unit attaches, onto an electrostatic latent image, the developer fed from the developer containing unit, wherein the engaged section includes a first engagement part and a second engagement part, the engaging section is engageable with any of the first engagement part and the second engagement part, and the engaging section is prevented from being in engagement with one of the first engagement part and the second engagement part when the engaging section is in engagement with the other of the first engagement part and the second engagement part.

10. The development processing unit according to claim 9, wherein the engaged section comprises two or more engaged sections.

11. An image forming apparatus comprising the development unit according to claim 1.

12. The image forming apparatus according to claim 11, further comprising:

a transferring unit that transfers, onto a medium, the developer attached onto the electrostatic latent image; and a fixing unit that fixes the developer transferred onto the medium.

* * * * *